US009242337B2

(12) United States Patent
Qian et al.

(10) Patent No.: US 9,242,337 B2
(45) Date of Patent: Jan. 26, 2016

(54) DYNAMIC RESIDUE CLEARING CONTROL WITH IN-SITU PROFILE CONTROL (ISPC)

(71) Applicant: Applied Materials, Inc., Santa Clara, CA (US)

(72) Inventors: Jun Qian, Sunnyvale, CA (US); Sivakumar Dhandapani, San Jose, CA (US); Benjamin Cherian, San Jose, CA (US); Thomas H. Osterheld, Mountain View, CA (US); Charles C. Garretson, Sunnyvale, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 151 days.

(21) Appl. No.: 14/185,185

(22) Filed: Feb. 20, 2014

(65) Prior Publication Data

US 2014/0273749 A1 Sep. 18, 2014

Related U.S. Application Data

(60) Provisional application No. 61/787,221, filed on Mar. 15, 2013.

(51) Int. Cl.
*B24B 49/12* (2006.01)
*B24B 49/10* (2006.01)
(Continued)

(52) U.S. Cl.
CPC ..... *B24B 35/005* (2013.01)

(58) Field of Classification Search
CPC ..... B24B 49/12; B24B 49/10; B24B 37/005
USPC ..... 451/5, 6, 8, 9, 10, 287, 288, 289, 290, 451/41, 57
See application file for complete search history.

(56) References Cited

U.S. PATENT DOCUMENTS 6,929,531 B2 * 8/2005 Gotkis ..... B24B 37/042 257/E21.304
7,063,597 B2 6/2006 Prabhu et al.
(Continued)

FOREIGN PATENT DOCUMENTS

JP 2013036881 A 2/2013

OTHER PUBLICATIONS

International Search Report and Written Opinion for International Application No. PCT/US2014/017277 dated Jun. 10, 2014.

*Primary Examiner* — Robert Rose
(74) *Attorney, Agent, or Firm* — Patterson & Sheridan, LLP

(57) ABSTRACT

A method for controlling the residue clearing process of a chemical mechanical polishing ("CMP") process is provided. Dynamic in-situ profile control ("ISPC") is used to control polishing before residue clearing starts, and then a new polishing recipe is dynamically calculated for the clearing process. Several different methods are disclosed for calculating the clearing recipe. First, in certain implementations when feedback at T0 or T1 methods are used, a post polishing profile and feedback offsets are generated in ISPC software. Based on the polishing profile and feedback generated from ISPC before the start of the clearing process, a flat post profile after clearing is targeted. The estimated time for the clearing step may be based on the previously processed wafers (for example, a moving average of the previous endpoint times). The calculated pressures may be scaled to a lower (or higher) baseline pressure for a more uniform clearing.

20 Claims, 20 Drawing Sheets

(51) Int. Cl.
*B24B 37/005* (2012.01)
*B24B 35/00* (2006.01)

(56) References Cited

U.S. PATENT DOCUMENTS

| | | | | |
|---|---|---|---|---|
| 8,292,693 | B2 | 10/2012 | David et al. | |
| 2003/0045100 | A1 | 3/2003 | Saka et al. | |
| 2006/0057812 | A1 | 3/2006 | Liu et al. | |
| 2007/0108066 | A1* | 5/2007 | Tsai | B23H 5/08 205/641 |
| 2007/0158201 | A1 | 7/2007 | Kollata et al. | |
| 2010/0105288 | A1 | 4/2010 | David et al. | |
| 2011/0269377 | A1 | 11/2011 | Qian et al. | |
| 2011/0281501 | A1 | 11/2011 | Qian et al. | |
| 2011/0300775 | A1* | 12/2011 | Zhang | B24B 49/12 451/5 |
| 2012/0034844 | A1 | 2/2012 | Zhang et al. | |
| 2012/0034845 | A1 | 2/2012 | Hu et al. | |
| 2012/0231701 | A1 | 9/2012 | Qian et al. | |
| 2012/0276817 | A1* | 11/2012 | Iravani | B24B 49/105 451/8 |
| 2014/0206259 | A1* | 7/2014 | Benvegnu | B24B 37/013 451/6 |

* cited by examiner

DYNAMIC RESIDUE CLEARING CONTROL WITH IN-SITU PROFILE CONTROL (ISPC)

CROSS-REFERENCE TO RELATED APPLICATIONS

This application claims benefit of U.S. Provisional Patent Application Ser. No. 61/787,221, filed Mar. 15, 2013, which is herein incorporated by reference in its entirety.

BACKGROUND

1. Field

Embodiments of the present invention generally relate to the monitoring and control of a chemical mechanical polishing process.

2. Description of the Related Art

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non planar surface. In addition, planarization of the substrate surface is usually required for photolithography.

Chemical mechanical polishing (CMP) is one accepted method of planarization. This planarization method typically requires that the substrate be mounted on a carrier head. The exposed surface of the substrate is typically placed against a rotating polishing pad with a durable roughened surface. The carrier head provides a controllable load on the substrate to push it against the polishing pad. A polishing liquid, such as a slurry with abrasive particles, is typically supplied to the surface of the polishing pad.

One problem in CMP is using an appropriate polishing rate to achieve a desirable profile, e.g., a substrate layer that has been planarized to a desired flatness or thickness, or a desired amount of material has been removed. Variations in the initial thickness of a substrate layer, the slurry composition, the polishing pad condition, the relative speed between the polishing pad and a substrate, and the load on a substrate can cause variations in the material removal rate across a substrate, and from substrate to substrate. These variations cause variations in the time needed to reach the polishing endpoint and the amount removed. Therefore, it may not be possible to determine the polishing endpoint merely as a function of the polishing time, or to achieve a desired profile merely by applying a constant pressure.

In some systems, a substrate is optically monitored in-situ during polishing, e.g., through a window in the polishing pad. However, existing optical monitoring techniques may not satisfy increasing demands of semiconductor device manufacturers.

SUMMARY

Implementations of the present invention generally relate to the monitoring and control of a chemical mechanical polishing process. In one implementation, a method for polishing a substrate is provided. The method comprises polishing a substrate having a plurality of zones to remove a bulk material layer in a polishing apparatus having a rotatable platen, wherein a polishing rate of each zone of the plurality of zones is independently controllable by an independently variable polishing parameter, storing a bulk target index value, measuring a first sequence of values from each zone of the plurality of zones during polishing with an in-situ monitoring system, for each zone of the plurality of zones, fitting a first linear function to the first sequence of values, for a reference zone from the plurality of zones, determining a projected bulk endpoint time at which the reference zone will reach the bulk target index value based on the first linear function of the reference zone, for at least one adjustable zone of the plurality of zones, calculating a first adjustment for the polishing parameter for the adjustable zone to adjust the polishing rate of the adjustable zone such that the adjustable zone is closer to the bulk target index value at the projected bulk endpoint time than without such adjustment, the calculation including calculating the adjustment based on an error value calculated for a previous substrate, after adjustment of the polishing parameter, for each zone, during polishing measuring a second sequence of values obtained after the first adjustment of the polishing parameter, for the at least one adjustable zone of each substrate, fitting a second linear function to the second sequence of values, calculating the error values for a subsequent substrate for the at least one adjustable zone based on the second linear function and a desired slope, determining a projected clearing endpoint time for removal of a residual material that either the first or second linear function of the reference zone will reach a clearing target index value, for at least one adjustable zone, calculating a second adjustment for the polishing parameter for the adjustable zone to adjust the polishing rate of the adjustable zone such that the adjustable zone is closer to the clearing target index value at the projected clearing endpoint time than without such adjustment, the calculation including calculating the adjustment based on an error value calculated for a previous substrate, continue polishing the plurality of zones to remove the bulk material layer until the bulk endpoint time passes and polishing the plurality of zones to remove the residual material layer using the second adjusted polishing parameter such that the adjustable zone is closer to the clearing target index value at the projected clearing endpoint.

In another implementation, a method for polishing a substrate is provided. The method comprises polishing a substrate having a plurality of zones to remove a bulk material layer in a polishing apparatus having a rotatable platen, wherein a polishing rate of each zone of the plurality of zones is independently controllable by an independently variable polishing parameter, obtaining measured current spectrum for current platen revolution for each zone of the plurality of zones, determining a reference spectrum that is a best match to the measured spectrum for each zone of the plurality of zones, generating a sequence of index values by determining an index value for each reference spectrum that is best fit, fitting a first linear function to the sequence of index values for each zone of the plurality of zones, determining an expected bulk endpoint time that the first linear function for a reference zone from the plurality of zones will reach a bulk target index value, adjusting polishing parameters for each zone of the plurality of zones including using error values from any prior substrate such that the plurality of zones have approximately the same index value at the expected bulk endpoint time, continue polishing, measuring spectra, determining error values and a second sequence of index values, and fitting a second linear function to the second sequence of index values, determining expected clearing endpoint time that either the first or second linear function for the reference zone will reach a clearing target index value, continue polishing the plurality of zones to remove the bulk material layer until the bulk endpoint time passes and adjusting polishing parameters to polish the plurality of zones including using error values from any prior substrate to remove a residual material layer after the bulk endpoint time passes.

BRIEF DESCRIPTION OF THE DRAWINGS

So that the manner in which the above recited features of the present invention can be understood in detail, a more particular description of the invention, briefly summarized above, may be had by reference to implementations, some of which are illustrated in the appended drawings. It is to be noted, however, that the appended drawings illustrate only typical implementations of this invention and are therefore not to be considered limiting of its scope, for the invention may admit to other equally effective implementations.

DETAILED DESCRIPTION

Figure 1:
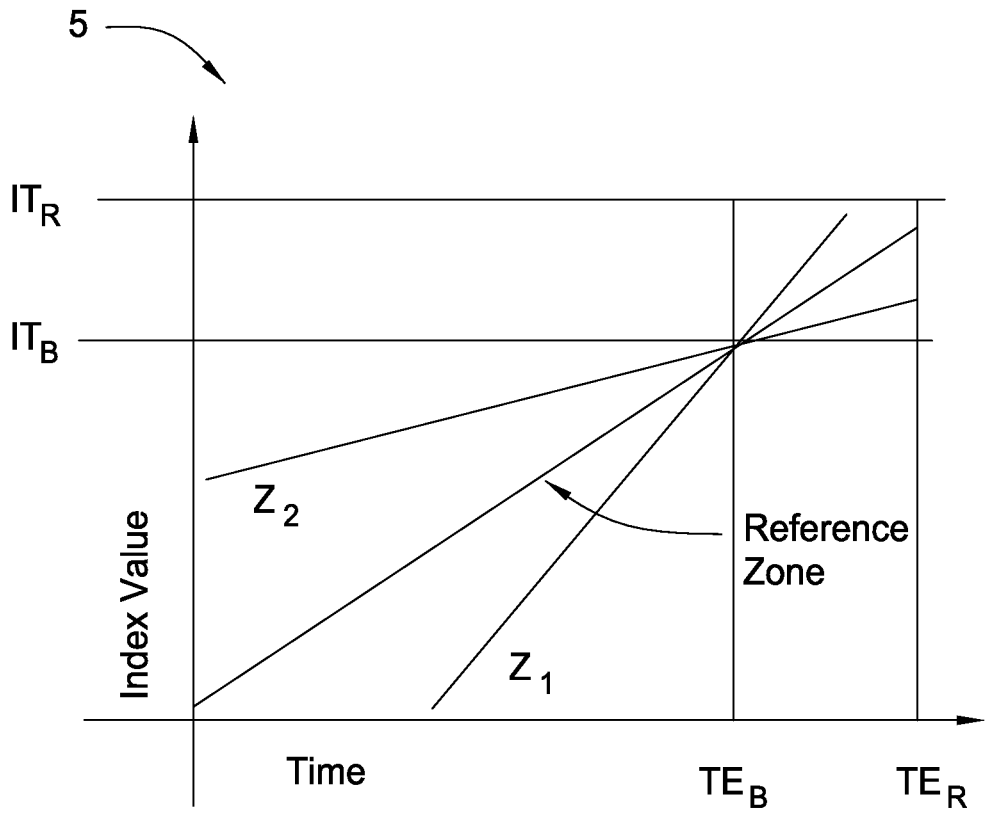
FIG. 1 illustrates a plot depicting the overpolishing of a substrate that occurs using polishing methods currently used in the art.

Implementations described herein generally relate to the monitoring and control of a chemical mechanical polishing process. The implementations described herein address the dynamic control of the residue clearing step of CMP processes such as shallow trench isolation ("STI") and replacement metal gate ("RMG") interlayer dielectric ("ILD"). Motor torque endpoint ("MT EP") and dynamic in-situ profile control ("ISPC") are currently used to control the bulk CMP polishing recipe prior to the residue clearing process. During the residue clearing process, the same bulk CMP polishing recipe is used to control the clearing process. Since ISPC typically targets a flat post profile before the clearing process begins, the ISPC pressures used during the bulk CMP polishing process tend to cause over-correction during the clearing process.

The implementations described herein provide several approaches for controlling the residue clearing process of the CMP polish. Dynamic ISPC is used to control polishing before residue clearing starts, and then a new polishing recipe is dynamically calculated for the clearing process. Several different methods are disclosed for calculating the clearing recipe. First, in certain implementations when feedback at T0 or T1 methods are used, a post polishing profile and feedback offsets are generated in ISPC software. Based on the polishing profile and feedback generated from ISPC before the start of the clearing process, a flat post profile after clearing is targeted. The estimated time for the clearing step may be based on the previously processed wafers (for example, a moving average of the previous endpoint times). The calculated pressures may be scaled to a lower (or higher) baseline pressure for a more uniform clearing. In certain implementations, based on the feedback generated from ISPC before clearing, a flat removal profile after clearing is targeted. The calculated pressures may be scaled to a lower (or higher) baseline pressure for a more uniform clearing. In certain implementations, a constant output pressure clearing recipe is used.

In certain implementations, instead of targeting a flat post profile before entering the residue clearing step, dynamic ISPC is used to target a flat post profile at the end of clearing step. The estimated endpoint target level for ISPC may be determined from open-loop wafers processed by Motor Torque Endpoint or other endpoint control methods. The same recipe may be used for both the bulk and clearing polish in this scenario. For subsequent wafers, ISPC can be used to control polishing pressures and endpoint. Feedback can be generated to automatically update the ISPC algorithm. Feedback can be calculated based on the index at the end of clearing or at the end of overpolishing, i.e., polished past a desired thickness. This method can be extended to any CMP residue clearing process. Polishing profile can be controlled with or without overpolish and polishing time can be controlled using other methods including automatic profile control ("APC"), optical or other friction measurements.

Implementations described herein will be described below in reference to a planarizing process and composition that can be carried out using chemical mechanical polishing process equipment, such as MIRRA™, MIRRA MESA™ REFLEXION®, REFLEXION LK™, and REFLEXION® GT™ chemical mechanical planarizing systems, available from Applied Materials, Inc. of Santa Clara, Calif. Other planarizing modules, including those that use processing pads, planarizing webs, or a combination thereof, and those that move a substrate relative to a planarizing surface in a rotational, linear, or other planar motion may also be adapted to benefit from the implementations described herein. In addition, any system enabling chemical mechanical polishing using the methods or compositions described herein can be used to advantage. The following apparatus description is illustrative and should not be construed or interpreted as limiting the scope of the implementations described herein.

FIG. 1 is a plot 5 depicting the overpolishing of a substrate that occurs using polishing methods currently used. The x-axis represents time and the y-axis represents the index value of the material being removed from the substrate. $IT_B$ represents the index value for the target thickness of the bulk polishing process. $IT_R$ represents the index value for the target thickness of the residual polishing process. $Z_1$ and $Z_2$ represent separate zones of the substrate surface. $E_B$ represents the polishing endpoint for the bulk polishing process and $E_R$ represents the polishing endpoint for the residual or clearing polishing process. Although two zones ($Z_1$ and $Z_2$) are depicted, the substrate may be divided into any number of zones. The Reference Zone depicts the desired polishing profile. Current polishing recipes use a combination of motor torque endpoint and dynamic in-situ profile control (ISPC) to achieve a uniform profile at $IT_B$. During the residue clearing process between $IT_B$ and $IT_R$, the same ISPC recipe as the bulk polish is used to control the clearing process or residual material removal process. Since ISPC typically targets a flat post profile before the clearing process begins, the ISPC pressures used to achieve the flat post profile at the intersection of $IT_B$ and $TE_B$ tend to cause over-correction which leads to overpolishing during the clearing process as shown by $Z_1$ and $Z_2$ between $TE_B$ and $TE_R$.

Figure 2A:
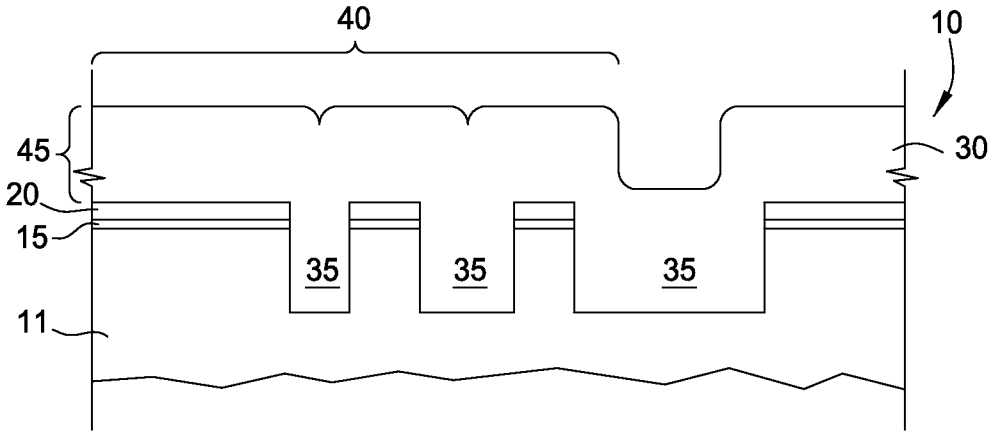
FIGS. 2A-2C illustrates schematic cross-sectional view of a substrate before and after polishing.
Figure 2B:
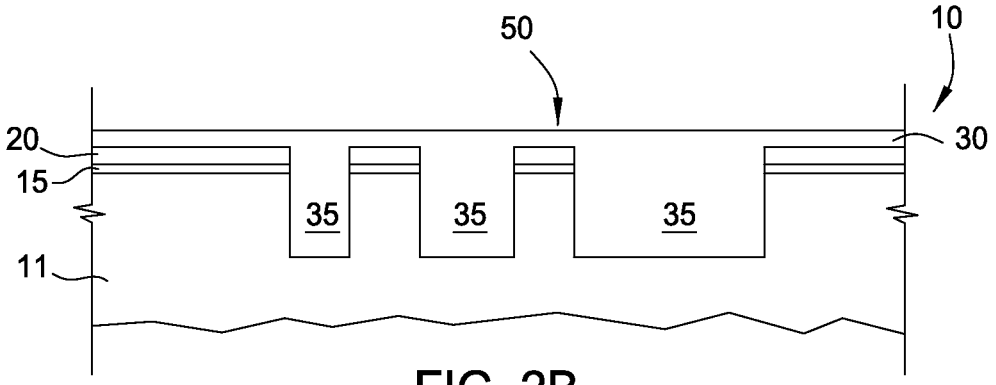
Figure 2C:
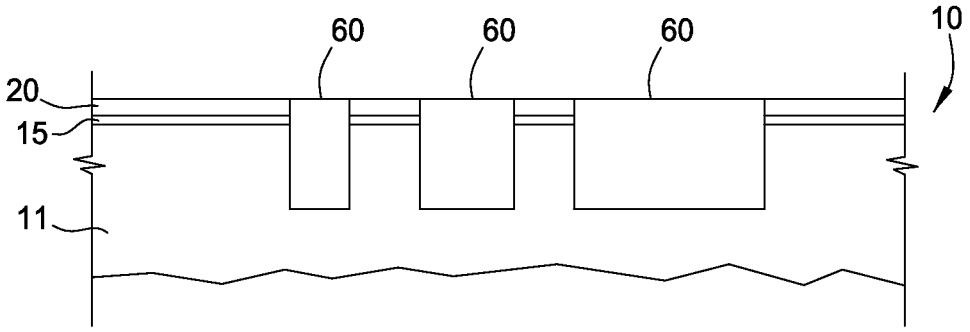

FIGS. 2A-2C are schematic cross-sectional view of a substrate before and after polishing. A substrate 10 having a patterned feature definitions 35 formed in a material layer 11, such as a polysilicon material or doped polysilicon layer, an oxide layer 15, such as silicon oxide, and a polishing/etch stop layer 20, such as a dielectric barrier or etch stop material, is subjected to a bulk deposition of a dielectric fill material 30 on the substrate surface in a sufficient amount to fill features definitions 35. The dielectric fill material is a first dielectric material, such as silicon oxide, and the dielectric barrier or etch stop material is a second dielectric material, such as silicon nitride.

The deposited dielectric fill material 30 generally has an excess material deposition 45 of bulk dielectric material, that has an uneven surface topography 40 with peak and recesses typically formed over feature definitions 35 having varying widths as shown in FIG. 2A. Dielectric fill material 30 is then polished in a first polishing step ending at a bulk endpoint time to remove the bulk of the dielectric fill material 30 over the polishing/etch stop layer 20 as shown in FIG. 2B. The remaining dielectric fill material, residual dielectric material 50, is then polished ending at a clearing endpoint time in a second polishing step to form a planarized surface with isolated features 60 as shown in FIG. 2C.

Figure 3:
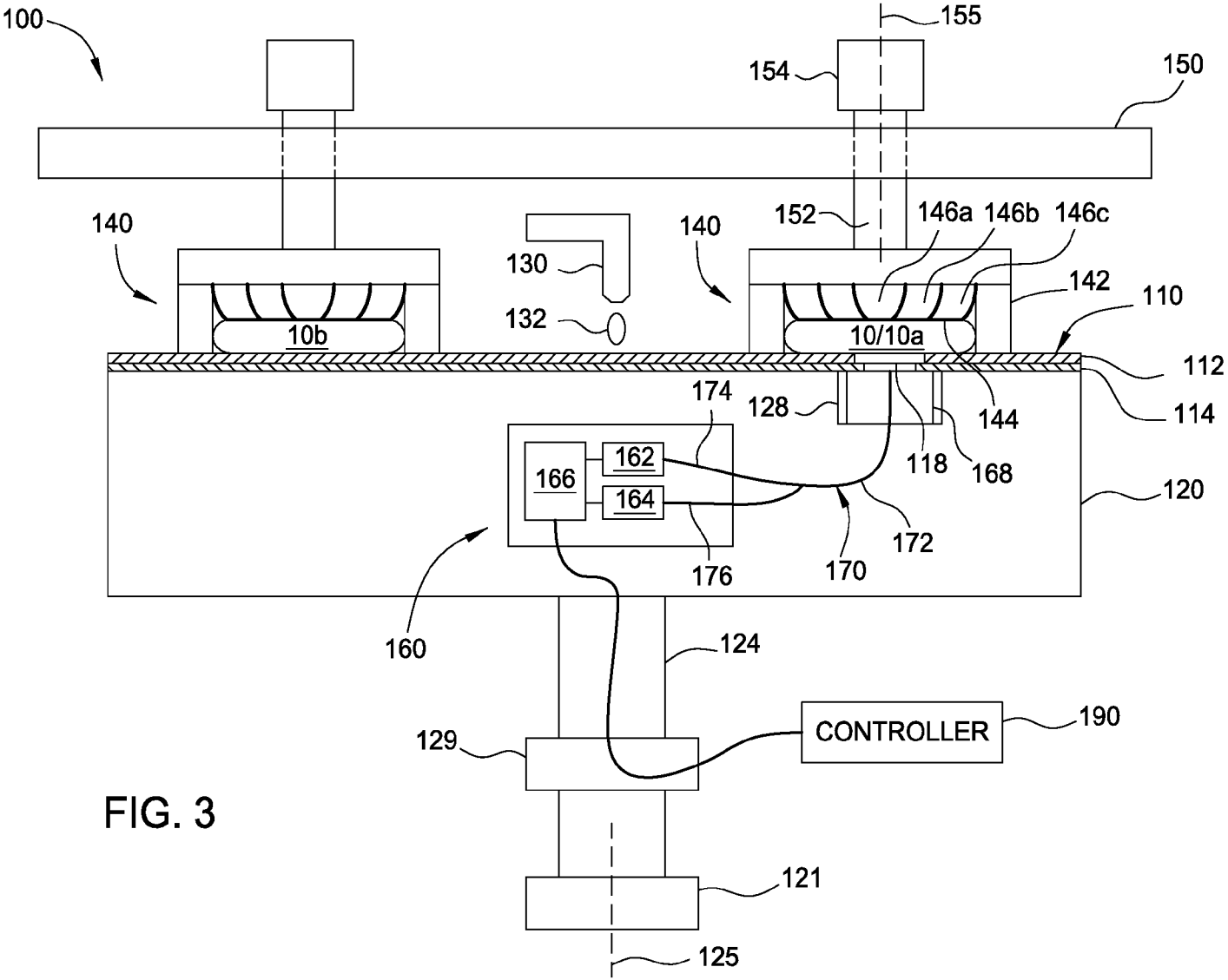
FIG. 3 illustrates a schematic cross-sectional view of an example of a polishing apparatus having two polishing heads.

FIG. 3 illustrates an example of a polishing apparatus 100. The polishing apparatus 100 includes a rotatable disk-shaped platen 120 on which a polishing pad 110 is situated. The platen 120 is operable to rotate about an axis 125. For example, a motor 121 can turn a drive shaft 124 to rotate the platen 120. The polishing pad 110 can be detachably secured to the platen 120, for example, by a layer of adhesive. The polishing pad 110 can be a two-layer polishing pad with an outer polishing layer 112 and a softer backing layer 114.

The polishing apparatus 100 can include a combined slurry/rinse arm 130. During polishing, the arm 130 is operable to dispense a polishing liquid 132, such as a slurry, onto the polishing pad 110. While only one slurry/rinse arm 130 is shown, additional nozzles, such as one or more dedicated slurry arms per carrier head, can be used. The polishing apparatus can also include a polishing pad conditioner to abrade the polishing pad 110 to maintain the polishing pad 110 in a consistent abrasive state.

In this implementation, the polishing apparatus 100 includes two (or two or more) carrier heads 140. Each carrier head 140 is operable to hold a substrate 10 (e.g., a first substrate 10*a* at one carrier head and a second substrate 10*b* at the other carrier head) against the polishing pad 110, i.e., the same polishing pad. Each carrier head 140 can have independent control of the polishing parameters, for example pressure, associated with each respective substrate. In some implementations, the polishing apparatus 100 includes multiple carrier heads, but the carrier heads (and the substrates held) are located over different polishing pads rather than the same polishing pad. For such implementations, the discussion below of obtaining simultaneous endpoint of multiple substrates on the same platen does not apply, but the discussion of obtaining simultaneous endpoint of multiple zones (albeit on a single substrate) would still be applicable.

Figure 4:
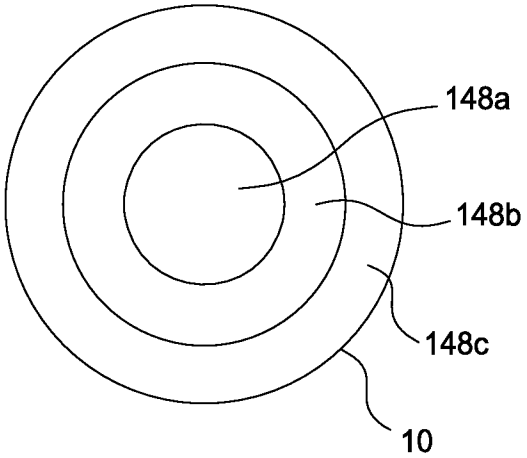
FIG. 4 illustrates a schematic top view of a substrate having multiple zones.

In particular, each carrier head 140 can include a retaining ring 142 to retain the substrate 10 below a flexible membrane 144. Each carrier head 140 also includes a plurality of independently controllable pressurizable chambers defined by the membrane, e.g., 3 chambers 146*a*-146*c*, which can apply independently controllable pressurizes to associated zones 148*a*-148*c* on the flexible membrane 144 and thus on the substrate 10 (see FIG. 4). Referring to FIG. 4, the center zone 148*a* can be substantially circular, and the remaining zones 148*b*-148*c* can be concentric annular zones around the center zone 148*a*. Although only three chambers are illustrated in FIGS. 3 and 4 for ease of illustration, there could be two chambers, or four or more chambers, e.g., five chambers.

Returning to FIG. 3, each carrier head 140 is suspended from a support structure 150, e.g., a carousel, and is connected by a drive shaft 152 to a carrier head rotation motor 154 so that the carrier head can rotate about an axis 155. Optionally each carrier head 140 can oscillate laterally, e.g., on sliders on the support structure 150; or by rotational oscillation of the carousel itself. In operation, the platen is rotated about its central axis 125, and each carrier head is rotated about its central axis 155 and translated laterally across the top surface of the polishing pad.

While only two carrier heads 140 are shown, more carrier heads can be provided to hold additional substrates so that the surface area of polishing pad 110 may be used efficiently. Thus, the number of carrier head assemblies adapted to hold substrates for a simultaneous polishing process can be based, at least in part, on the surface area of the polishing pad 110.

The polishing apparatus also includes an in-situ monitoring system 160, which can be used to determine whether to adjust a polishing rate or an adjustment for the polishing rate as discussed below. The in-situ monitoring system 160 can include an optical monitoring system, e.g., a spectrographic monitoring system, or an eddy current monitoring system.

In one implementation, the monitoring system 160 is an optical monitoring system. An optical access through the polishing pad is provided by including an aperture (i.e., a hole that runs through the pad) or a solid window 118. The solid window 118 can be secured to the polishing pad 110, e.g., as a plug that fills an aperture in the polishing pad, e.g., is molded to or adhesively secured to the polishing pad, although in some implementations the solid window can be supported on the platen 120 and project into an aperture in the polishing pad.

The optical monitoring system 160 can include a light source 162, a light detector 164, and circuitry 166 for sending and receiving signals between a remote controller 190, e.g., a computer, and the light source 162 and light detector 164. One or more optical fibers can be used to transmit the light from the light source 162 to the optical access in the polishing pad, and to transmit light reflected from the substrate 10 to the detector 164. For example, a bifurcated optical fiber 170 can be used to transmit the light from the light source 162 to the substrate 10 and back to the detector 164. The bifurcated optical fiber an include a trunk 172 positioned in proximity to the optical access, and two branches 174 and 176 connected to the light source 162 and detector 164, respectively.

In some implementations, the top surface of the platen can include a recess 128 into which is fit an optical head 168 that holds one end of the trunk 172 of the bifurcated fiber. The optical head 168 can include a mechanism to adjust the vertical distance between the top of the trunk 172 and the solid window 118.

The output of the circuitry 166 can be a digital electronic signal that passes through a rotary coupler 129, e.g., a slip ring, in the drive shaft 124 to the controller 190 for the optical monitoring system. Similarly, the light source can be turned on or off in response to control commands in digital electronic signals that pass from the controller 190 through the rotary coupler 129 to the optical monitoring system 160. Alternatively, the circuitry 166 could communicate with the controller 190 by a wireless signal.

The light source 162 can be operable to emit white light. In one implementation, the white light emitted includes light having wavelengths of 200-800 nanometers. A suitable light source is a xenon lamp or a xenon mercury lamp.

The light detector 164 can be a spectrometer. A spectrometer is an optical instrument for measuring intensity of light over a portion of the electromagnetic spectrum. A suitable spectrometer is a grating spectrometer. Typical output for a spectrometer is the intensity of the light as a function of wavelength (or frequency).

As noted above, the light source 162 and light detector 164 can be connected to a computing device, e.g., the controller 190, operable to control their operation and receive their signals. The computing device can include a microprocessor situated near the polishing apparatus, e.g., a programmable computer. With respect to control, the computing device can, for example, synchronize activation of the light source with the rotation of the platen 120.

In some implementations, the light source 162 and detector 164 of the in-situ monitoring system 160 are installed in and rotate with the platen 120. In this case, the motion of the platen will cause the sensor to scan across each substrate. In particular, as the platen 120 rotates, the controller 190 can cause the light source 162 to emit a series of flashes starting just before and ending just after each substrate 10 passes over the optical access. Alternatively, the computing device can cause the light source 162 to emit light continuously starting just before and ending just after each substrate 10 passes over the optical access. In either case, the signal from the detector can be integrated over a sampling period to generate spectra measurements at a sampling frequency.

In operation, the controller 190 can receive, for example, a signal that carries information describing a spectrum of the light received by the light detector for a particular flash of the light source or time frame of the detector. Thus, this spectrum is a spectrum measured in-situ during polishing.

Figure 5A:
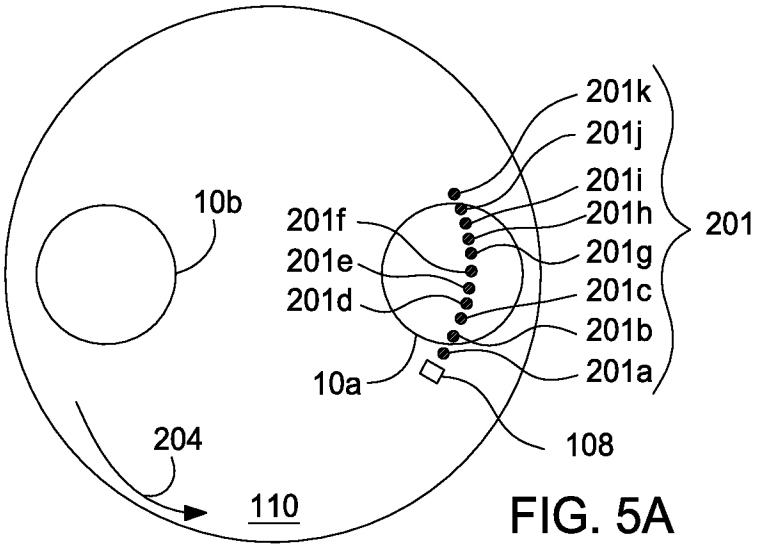
FIG. 5A illustrates a top view of a polishing pad and show locations where in-situ measurements are taken on a first substrate.
Figure 5B:
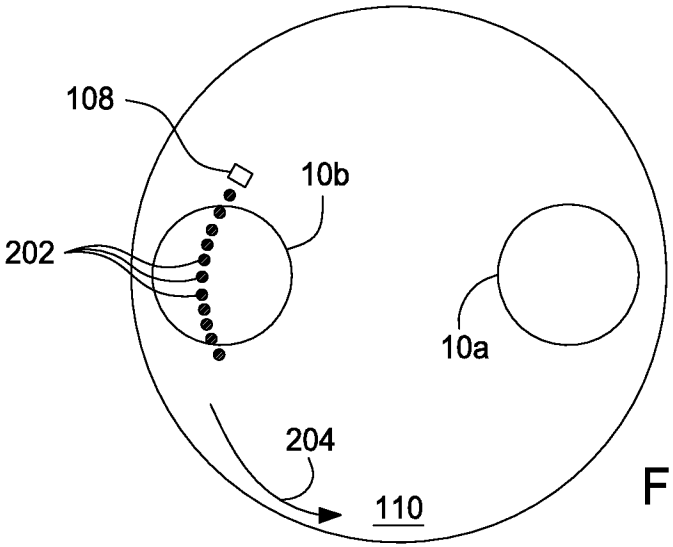
FIG. 5B illustrates a top view of a polishing pad and show locations where in-situ measurements are taken on a second substrate.

As shown by in FIG. 5A, if the detector is installed in the platen, due to the rotation of the platen (shown by arrow 204), as the window 108 travels below one carrier head (e.g., the carrier head holding the first substrate 10*a*), the optical monitoring system making spectra measurements at a sampling frequency will cause the spectra measurements to be taken at locations 201 in an arc that traverses the first substrate 10*a*. For example, each of points 201*a*-201*k* represents a location of a spectrum measurement by the monitoring system of the first substrate 10*a* (the number of points is illustrative; more or fewer measurements can be taken than illustrated, depending on the sampling frequency). As shown, over one rotation of the platen, spectra are obtained from different radii on the substrate 10*a*. That is, some spectra are obtained from locations closer to the center of the substrate 10*a* and some are closer to the edge. Similarly, as shown by in FIG. 5B, due to the rotation of the platen, as the window travels below the other carrier head (e.g., the carrier head holding the second substrate 10*b*) the optical monitoring system making spectra measurements at the sampling frequency will cause the spectra measurements to be taken at locations 202 along an arc that traverses the second substrate 10*b*.

Thus, for any given rotation of the platen, based on timing and motor encoder information, the controller can determine which substrate, e.g., substrate 10*a* or 10*b*, is the source of the measured spectrum. In addition, for any given scan of the optical monitoring system across a substrate, e.g., substrate 10*a* or 10*b*, based on timing, motor encoder information, and optical detection of the edge of the substrate and/or retaining ring, the controller 190 can calculate the radial position (relative to the center of the particular substrate 10*a* or 10*b* being scanned) for each measured spectrum from the scan. The polishing system can also include a rotary position sensor, e.g., a flange attached to an edge of the platen that will pass through a stationary optical interrupter, to provide additional data for determination of which substrate and the position on the substrate of the measured spectrum. The controller can thus associate the various measured spectra with the controllable zones 148*a*-148*c* (see FIG. 4) on the substrates 10*a* and 10*b*. In some implementations, the time of measurement of the spectrum can be used as a substitute for the exact calculation of the radial position.

Over multiple rotations of the platen, for each zone of each substrate, a sequence of spectra can be obtained over time. Without being limited to any particular theory, the spectrum of light reflected from the substrate 10 evolves as polishing progresses (e.g., over multiple rotations of the platen, not during a single sweep across the substrate) due to changes in the thickness of the outermost layer, thus yielding a sequence of time-varying spectra. Moreover, particular spectra are exhibited by particular thicknesses of the layer stack.

In some implementations, the controller, e.g., the computing device, can be programmed to compare a measured spectrum to multiple reference spectra to determine which reference spectrum provides the best match. In particular, the controller can be programmed to compare each spectrum from a sequence of measured spectra from each zone of each substrate to multiple reference spectra to generate a sequence of best matching reference spectra for each zone of each substrate.

As used herein, a reference spectrum is a predefined spectrum generated prior to polishing of the substrate. A reference spectrum can have a pre-defined association, i.e., defined prior to the polishing operation, with a value representing a time in the polishing process at which the spectrum is expected to appear, assuming that the actual polishing rate follows an expected polishing rate. Alternatively or in addition, the reference spectrum can have a pre-defined association with a value of a substrate property, such as a thickness of the outermost layer.

A reference spectrum can be generated empirically, e.g., by measuring the spectra from a test substrate, e.g., a test substrate having a known initial layer thicknesses. For example, to generate a plurality of reference spectra, a set-up substrate is polished using the same polishing parameters that would be used during polishing of device wafers while a sequence of spectra are collected. For each spectrum, a value is recorded representing the time in the polishing process at which the spectrum was collected. For example, the value can be an elapsed time, or a number of platen rotations. The substrate can be overpolished so that the spectrum of the light that reflected from the substrate when the target thickness is achieved can be obtained.

In order to associate each spectrum with a value of a substrate property, e.g., a thickness of the outermost layer, the initial spectra and property of a "set-up" substrate with the same pattern as the product substrate can be measured pre-polish at a metrology station. The final spectrum and property can also be measured post-polish with the same metrology station or a different metrology station. The properties for spectra between the initial spectra and final spectra can be determined by interpolation, e.g., linear interpolation based on elapsed time at which the spectra of the test substrate was measured.

In addition to being determined empirically, some or all of the reference spectra can be calculated from theory, e.g., using an optical model of the substrate layers. For example, and optical model can be used to calculate a reference spectrum for a given outer layer thickness D. A value representing the time in the polishing process at which the reference spectrum would be collected can be calculated, e.g., by assuming that the outer layer is removed at a uniform polishing rate. For example, the time Ts for a particular reference spectrum can be calculated simply by assuming a starting thickness D0 and uniform polishing rate R (Ts=(D0−D)/R). As another example, linear interpolation between measurement times T1, T2 for the pre-polish and post-polish thicknesses D1, D2 (or other thicknesses measured at the metrology station) based on the thickness D used for the optical model can be performed (Ts=T2−T1"(D1−D)/(D1−D2)).

Figure 7:
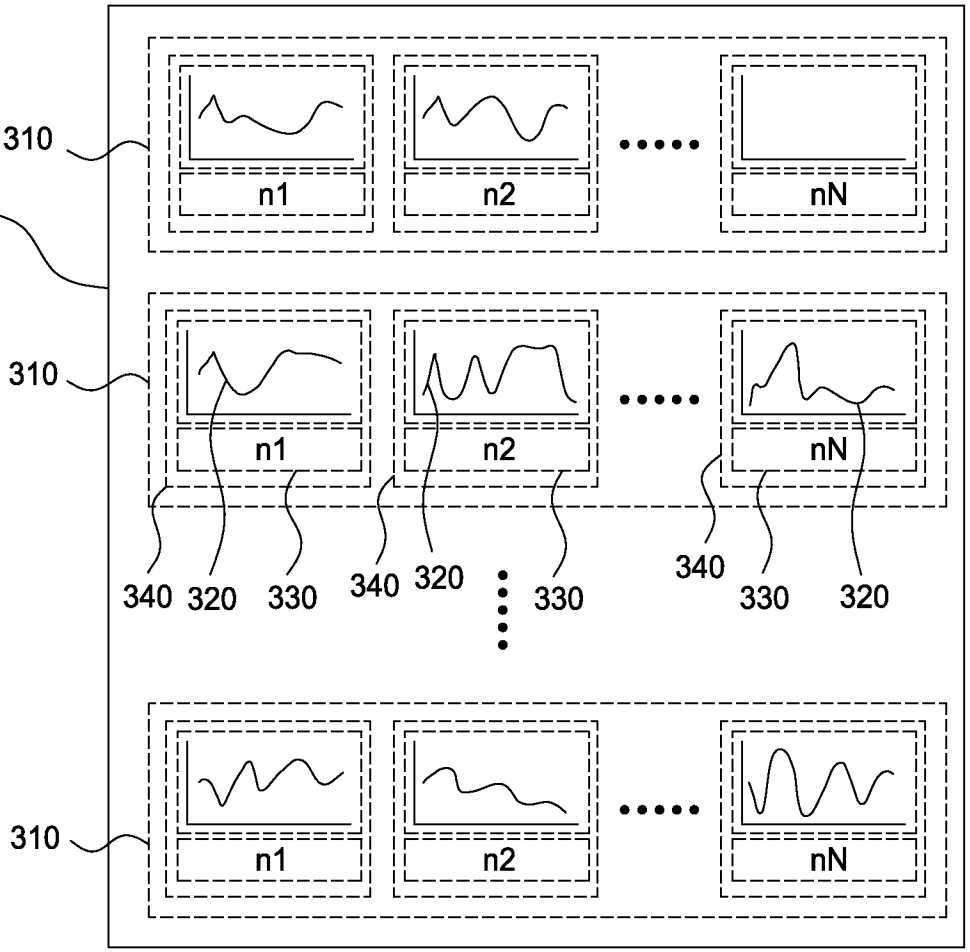
FIG. 7 illustrates a library of reference spectrum.
Figure 6:
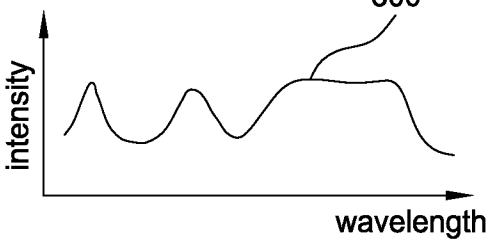
FIG. 6 illustrates a measured spectrum from the in-situ optical monitoring system.

Referring to FIGS. 6 and 7, during polishing, a measured spectrum 300 (see FIG. 6) can be compared to reference spectra 320 from one or more libraries 310 (see FIG. 7). As used herein, a library of reference spectra is a collection of reference spectra which represent substrates that share a property in common. However, the property shared in common in a single library may vary across multiple libraries of reference spectra. For example, two different libraries can include reference spectra that represent substrates with two different underlying thicknesses. For a given library of reference spectra, variations in the upper layer thickness, rather than other factors (such as differences in wafer pattern, underlying layer thickness, or layer composition), can primarily responsible for the differences in the spectral intensities.

Reference spectra 320 for different libraries 310 can be generated by polishing multiple "set-up" substrates with different substrate properties (e.g., underlying layer thicknesses, or layer composition) and collecting spectra as discussed above; the spectra from one set-up substrate can provide a first library and the spectra from another substrate with a different underlying layer thickness can provide a second library. Alternatively or in addition, reference spectra for different libraries can be calculated from theory, e.g., spectra for a first library can be calculated using the optical model with the underlying layer having a first thickness, and spectra for a second library can be calculated using the optical model with the underlying layer having a different one thickness.

In some implementations, each reference spectrum 320 is assigned an index value 330. In general, each library 310 can include many reference spectra 320, e.g., one or more, e.g., exactly one, reference spectra for each platen rotation over the expected polishing time of the substrate. This index 330 can be the value, e.g., a number, representing the time in the polishing process at which the reference spectrum 320 is expected to be observed. The spectra can be indexed so that each spectrum in a particular library has a unique index value. The indexing can be implemented so that the index values are sequenced in an order in which the spectra were measured. An index value can be selected to change monotonically, e.g., increase or decrease, as polishing progresses. In particular, the index values of the reference spectra can be selected so that they form a linear function of time or number of platen rotations (assuming that the polishing rate follows that of the model or test substrate used to generate the reference spectra in the library). For example, the index value can be proportional, e.g., equal, to a number of platen rotations at which the reference spectra was measured for the test substrate or would appear in the optical model. Thus, each index value can be a whole number. The index number can represent the expected platen rotation at which the associated spectrum would appear.

The reference spectra and their associated index values can be stored in a reference library. For example, each reference spectrum 320 and its associated index value 330 can be stored in a record 340 of database 350. The database 350 of reference libraries of reference spectra can be implemented in memory of the computing device of the polishing apparatus.

In some implementations, the reference spectra can be generated automatically for a given lot of substrates. The first substrate of a lot, or the first substrate having a new device/mask pattern, is polished while the optical monitoring system measures spectra, but without control of the polishing rate (discussed below with reference to FIGS. 11-13). This generates a sequence of spectra for the first substrate, with at least one spectrum per zone per sweep of the window below the substrate, e.g., per platen rotation.

A set of reference spectra, e.g., for each zone, is automatically generated from the sequence of spectra for this first substrate. In brief, the spectra measured from the first substrate become the reference spectra. More particularly, the spectra measured from each zone of the first substrate become the reference spectra for that zone. Each reference spectrum is associated with the platen rotation number at which it was measured from the first substrate. If there are multiple measured spectra for a particular zone of the first substrate at a particular platen rotation, then the measured spectra can be combined, e.g., averaged to generate an average spectrum for that platen rotation. Alternatively, the reference library can simply keep each spectrum as a separate reference spectrum, and compare the measured spectrum of the subsequent substrate against each reference spectrum to find the best match, as described below. Optionally, the database can store a default set of reference spectra, which are then replaced by the set of reference spectra generated from the sequence of spectra from the first substrate.

As noted above, the target index value can also be generated automatically. In some implementations, the first substrate is polished for a fixed polishing time, and the platen rotation number at the end of the fixed polishing time can be set as the target index value. In some implementations, instead of a fixed polishing time, some form of wafer-to-wafer feed-forward or feedback control from the factory host or CMP tool (e.g., as described in U.S. application Ser. No. 12/625,480, issued as U.S. Pat. No. 8,292,693) can be used to adjust the polishing time for the first wafer. The platen rotation number at the end of the adjusted polishing time can be set as the target index value.

In some implementations, as shown in FIG. 3, the polishing system can include another endpoint detection system (not shown) (other than the spectrographic optical monitoring system 160), e.g., using friction measurement (e.g., as described in U.S. Pat. No. 7,513,818), eddy current (e.g., as described in U.S. Pat. No. 6,924,641), motor torque (e.g., as described in U.S. Pat. No. 5,846,882 or monochromatic light, e.g., a laser (e.g., as described in U.S. Pat. No. 6,719,818). The other endpoint detection system can be in a separate recess in the platen, or in the same recess 128 as the optical monitoring system 160. In addition, although illustrated in FIG. 3 as on the opposite side of the axis of rotation of the platen 120, this is not necessary, although the sensor of the endpoint detection system can have the same radial distance from the axis 125 as the optical monitoring system 160. This other endpoint detection system can be used to detect the polishing endpoint of the first substrate, and the platen rotation number at the time that the other endpoint detection system detects the endpoint can be set as the target index value. In some implementations, a post-polish thickness measurement of the first substrate can be made, and an initial target index value as determined by one of the techniques above can be adjusted, e.g., by linear scaling, e.g., by multiplying by the ratio of the target thickness to the post-polish measured thickness.

In addition, the target index value can be further refined based on new substrates processed and the new desired endpoint time. In some implementations, rather than using just the first substrate to set the target index value, the target index can be dynamically determined based on a multiple previously polished substrates, e.g., by combining, e.g., weighted averaging, of the endpoint times indicated by the wafer-to-wafer feed-forward or feedback control or the other endpoint detection systems. A predefined number of the previously polished substrates, e.g., four or less, that were polished immediately prior to the present substrate, can be used in the calculation.

In any event, once a target index value has been determined, one or more subsequent substrates can be polished using the techniques described below to adjust the pressure applied to one or more zones so that the zones reach the target index at closer to the same time (or at an expected endpoint time, are closer to their target index) than without such adjustment.

As noted above, for each zone of each substrate, based on the sequence of measured spectra or that zone and substrate, the controller 190 can be programmed to generate a sequence of best matching spectra. A best matching reference spectrum can be determined by comparing a measured spectrum to the reference spectra from a particular library.

In some implementations, the best matching reference spectrum can be determined by calculating, for each reference spectra, a sum of squared differences between the measured spectrum and the reference spectrum. The reference spectrum with the lowest sum of squared differences has the best fit. Other techniques for finding a best matching reference spectrum are possible.

A method that can be applied to decrease computer processing is to limit the portion of the library that is searched for matching spectra. The library typically includes a wider range of spectra than will be obtained while polishing a substrate. During substrate polishing, the library searching is limited to a predetermined range of library spectra. In some implementations, the current rotational index N of a substrate being polished is determined. For example, in an initial platen rotation, N can be determined by searching all of the reference spectra of the library. For the spectra obtained during a subsequent rotation, the library is searched within a range of freedom of N. That is, if during one rotation the index number is found to be N, during a subsequent rotation which is X rotations later, where the freedom is Y, the range that will be searched from (N+X)−Y to (N+X)+Y.

Figure 8:
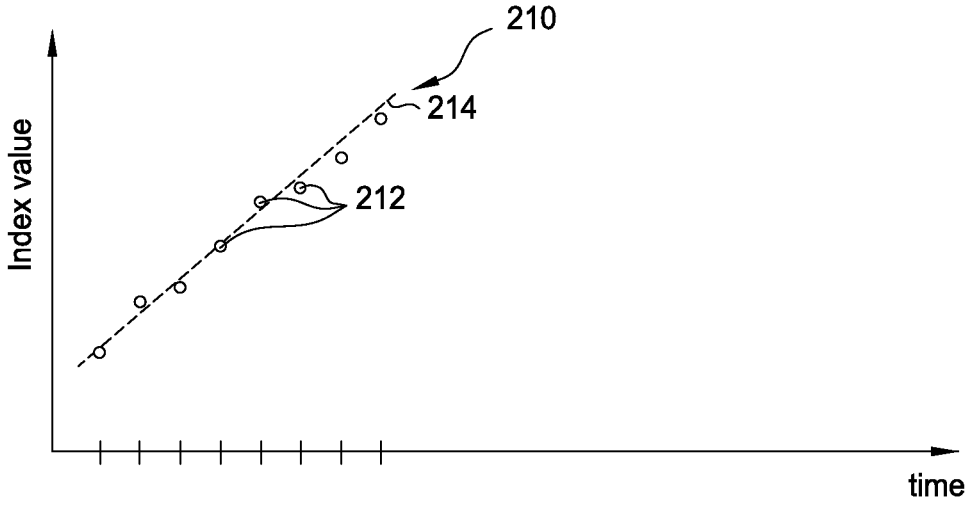
FIG. 8 illustrates an index trace.

Referring to FIG. 8, which illustrates the results for only a single zone of a single substrate, the index value of each of the best matching spectra in the sequence can be determined to generate a time-varying sequence of index values 212. This sequence of index values can be termed an index trace 210. In some implementations, an index trace is generated by comparing each measured spectrum to the reference spectra from exactly one library. In general, the index trace 210 can include one, e.g., exactly one, index value per sweep of the optical monitoring system below the substrate.

For a given index trace 210, where there are multiple spectra measured for a particular substrate and zone in a single sweep of the optical monitoring system (termed "current spectra"), a best match can be determined between each of the current spectra and the reference spectra of one or more, e.g., exactly one, library. In some implementations, each selected current spectra is compared against each reference spectra of the selected library or libraries. Given current spectra e, f, and g, and reference spectra E, F, and G, for example, a matching coefficient could be calculated for each of the following combinations of current and reference spectra: e and E, e and F, e and G, f and E, f and F, f and G, g and E, g and F, and g and G. Whichever matching coefficient indicates the best match, e.g., is the smallest, determines the best-matching reference spectrum, and thus the index value. Alternatively, in some implementations, the current spectra can be combined, e.g., averaged, and the resulting combined spectrum is compared against the reference spectra to determine the best match, and thus the index value.

In some implementations, for at least some zones of some substrates, a plurality of index traces can be generated. For a given zone of a given substrate, an index trace can be generated for each reference library of interest. That is, for each reference library of interest to the given zone of the given substrate, each measured spectrum in a sequence of measured spectra is compared to reference spectra from a given library, a sequence of the best matching reference spectra is determined, and the index values of the sequence of best matching reference spectra provide the index trace for the given library.

In summary, each index trace includes a sequence 210 of index values 212, with each particular index value 212 of the sequence being generated by selecting the index of the reference spectrum from a given library that is the closest fit to the measured spectrum. The time value for each index of the index trace 210 can be the same as the time at which the measured spectrum was measured.

Figure 9:
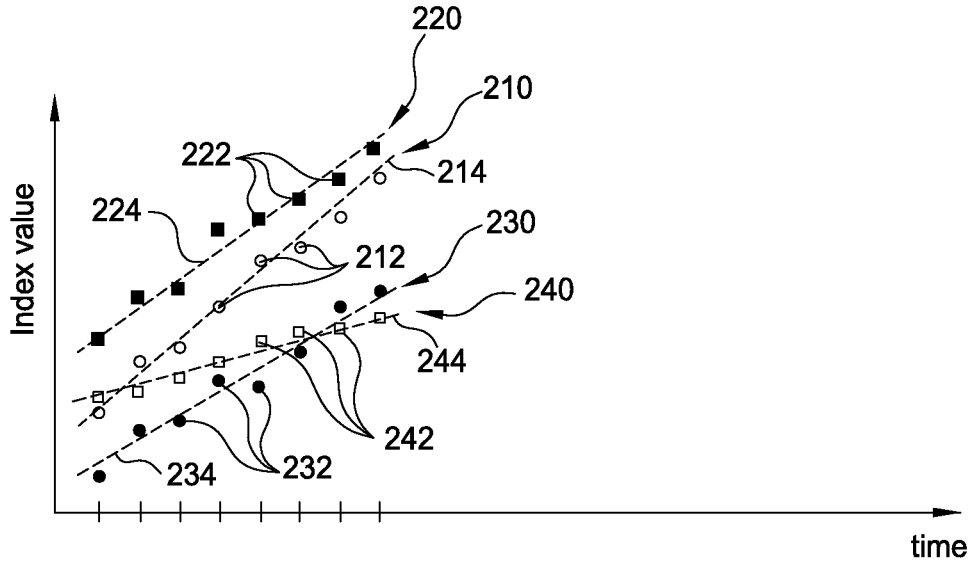
FIG. 9 illustrates a plurality of index traces for different zones of different substrates.

Referring to FIG. 9, a plurality of index traces is illustrated. As discussed above, an index trace can be generated for each zone of each substrate. For example, a first sequence 210 of index values 212 (shown by hollow circles) can be generated for a first zone of a first substrate, a second sequence 220 of index values 222 (shown by solid squares) can be generated for a second zone of the first substrate, a third sequence 230 of index values 232 (shown by solid circles) can be generated for a first zone of a second substrate, and a fourth sequence 240 of index values 242 (shown by empty circles) can be generated for a second zone of the second substrate.

As shown in FIG. 9, for each substrate index trace, a polynomial function of known order, e.g., a first-order function (e.g., a line) is fit to the sequence of index values for the associated zone and wafer, e.g., using robust line fitting. For example, a first line 214 can be fit to index values 212 for the first zone of the first substrate, a second line 224 can be fit to the index values 222 of the second zone of the first substrate, a third line 234 can be fit to the index values 232 of the first zone of the second substrate, and a fourth line 244 can be fit to the index values 242 of the second zone of the second substrate. Fitting of a line to the index values can include calculation of the slope S of the line and an x-axis intersection time T at which the line crosses a starting index value, e.g., 0. The function can be expressed in the form I(t)=S(t−T), where t is time. The x-axis intersection time T can have a negative value, indicating that the starting thickness of the substrate layer is less than expected. Thus, the first line 214 can have a first slope S1 and a first x-axis intersection time T1, the second line 224 can have a second slope S2 and a second x-axis intersection time T2, the third line 234 can have a third slope S3 and a third x-axis intersection time T3, and the fourth line 244 can have a fourth slope S4 and a fourth x-axis intersection time T4.

Where multiple substrates are being polished simultaneously, e.g., on the same polishing pad, polishing rate variations between the substrates can lead to the substrates reaching their target thickness at different times. On the one hand, if polishing is halted simultaneously for the substrates, then some will not be at the desired thickness. On the other hand, if polishing for the substrates is stopped at different times, then some substrates may have defects and the polishing apparatus is operating at lower throughput.

By determining a polishing rate for each zone for each substrate from in-situ measurements, a projected endpoint time for a target thickness or a projected thickness for target endpoint time can be determined for each zone for each substrate, and the polishing rate for at least one zone of at least one substrate can be adjusted so that the substrates achieve closer endpoint conditions. By "closer endpoint conditions," it is meant that the zones of the substrates would reach their target thickness closer to the same time than without such adjustment, or if the substrates halt polishing at the same time, that the zones of the substrates would have closer to the same thickness than without such adjustment.

At some during the polishing process, e.g., at a time T0, a polishing parameter for at least one zone of at least one substrate, e.g., at least one zone of every substrate, is adjusted to adjust the polishing rate of the zone of the substrate such that at a polishing endpoint time, the plurality of zones of the plurality of substrates are closer to their target thickness than without such adjustment. In some implementations, each zone of the plurality of substrates can have approximately the same thickness at the endpoint time.

Figure 10:
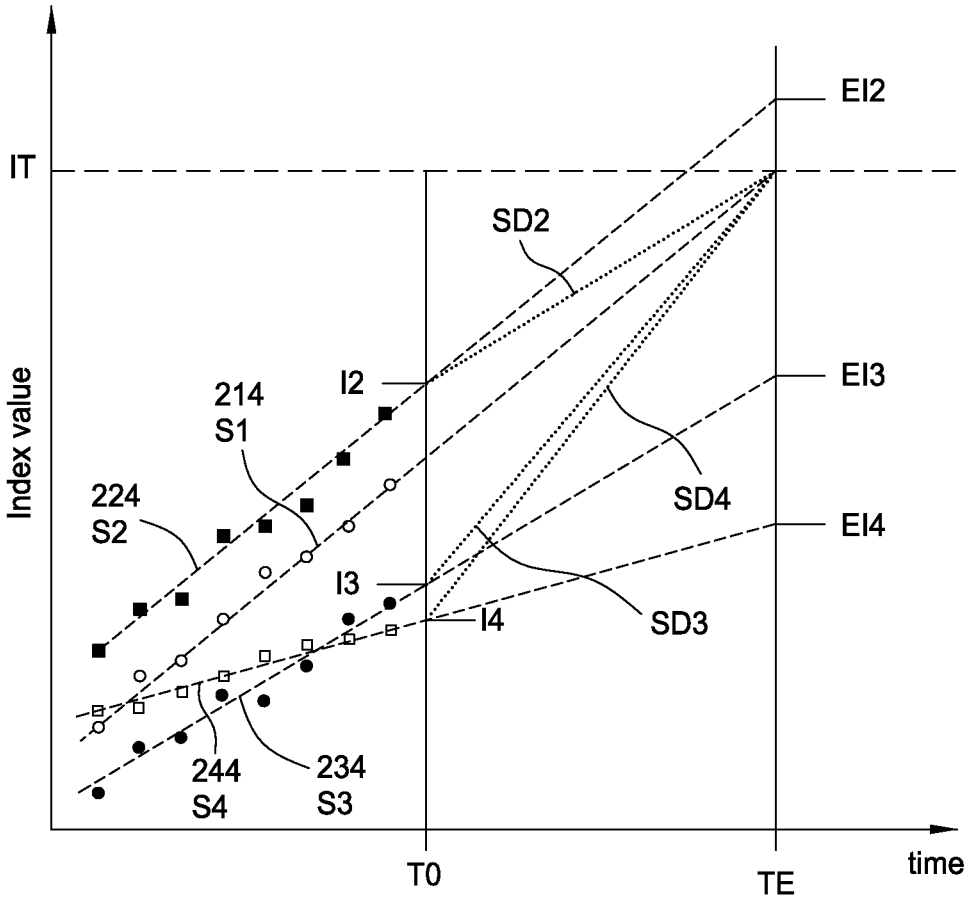
FIG. 10 illustrates a calculation of a plurality of desired slopes for a plurality of adjustable zones based on a time that an index trace of a reference zone reaches a target index.

Referring to FIG. 10, in some implementations, one zone of one substrate is selected as a reference zone, and a projected endpoint time TE at which the reference zone will reach a target index IT is determined. In certain implementations, the projected endpoint time TE may be the projected bulk endpoint time ($TE_B$) of the projected residual clearing endpoint time ($TE_R$) For example, as shown in FIG. 10, the first zone of the first substrate is selected as the reference zone, although a different zone and/or a different substrate could be selected. The target thickness IT is set by the user prior to the polishing operation and stored.

In order to determine the projected time at which the reference zone will reach the target index, the intersection of the line of the reference zone, e.g., line 214, with the target index, IT, can be calculated. Assuming that the polishing rate does not deviate from the expected polishing rate through the remainder polishing process, then the sequence of index values should retain a substantially linear progression. Thus, the expected endpoint time TE can be calculated as a simple linear interpolation of the line to the target index IT, e.g., IT=S(TE−T). Thus, in the example of FIG. 11 in which the first zone of the second substrate is selected as the reference zone, with associated third line 234, IT=S1(TE−T1), i.e., TE=IT/S1−T1.

One or more zones, e.g., all zones, other than the reference zone (including zones on other substrates) can be defined as adjustable zones. Where the lines for the adjustable zones meet the expected endpoint time TE define projected endpoint for the adjustable zones. The linear function of each adjustable zone, e.g., lines 224, 234 and 244 in FIG. 11, can thus be used to extrapolate the index, e.g., E12, E13 and E14, that will be achieved at the expected endpoint time ET for the associated zone. For example, the second line 224 can be used to extrapolate the expected index, E12, at the expected endpoint time ET for the second zone of the first substrate, the third line 234 can be used to extrapolate the expected index, E13, at the expected endpoint time ET for the first zone of the second substrate, and the fourth line can be used to extrapolate the expected index, E14, at the expected endpoint time ET for the second zone of the second substrate.

Figure 11:
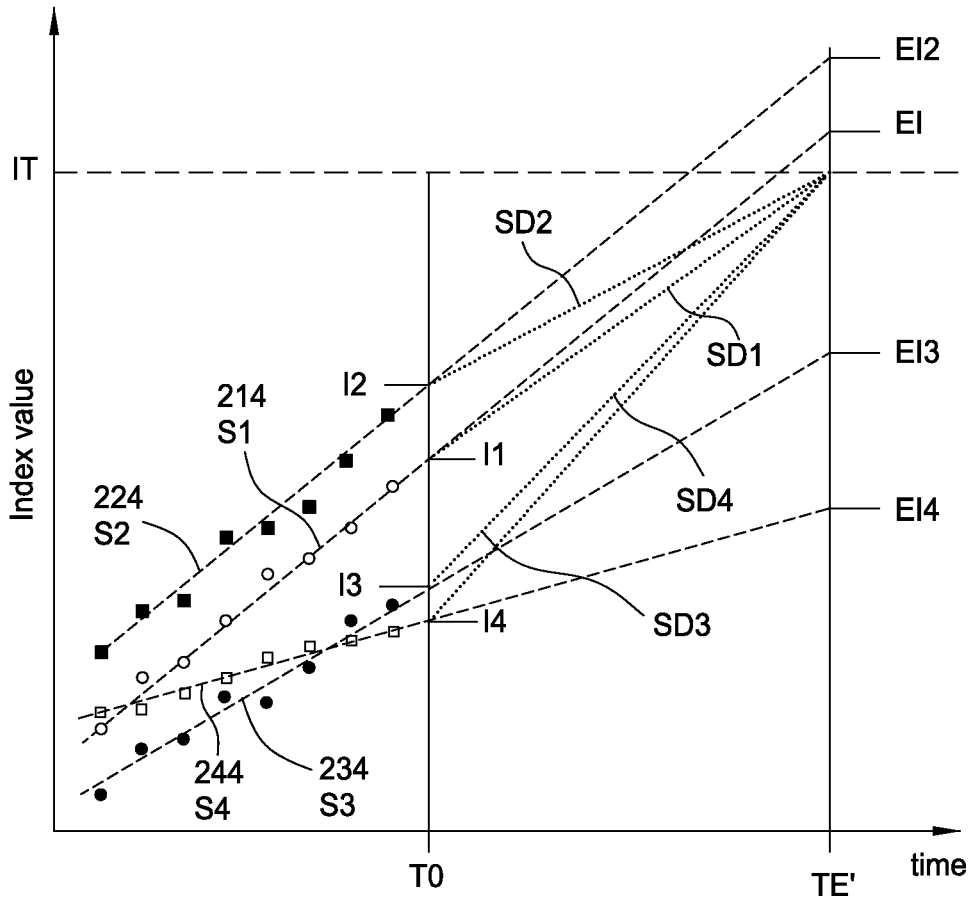
FIG. 11 illustrates a calculation of a plurality of desired slopes for a plurality of adjustable zones based on a time that an index trace of a reference zone reaches a target index.

As shown in FIG. 11, if no adjustments are made to the polishing rate of any of the zones of any the substrates after time T0, then if endpoint is forced at the same time for all substrates, then each substrate can have a different thickness, or each substrate could have a different endpoint time (which is not desirable because it can lead to defects and loss of throughput). Here, for example, the second zone of the first substrate (shown by line 224) would endpoint at an expected index E12 greater (and thus a thickness less) than the expected index of the first zone of the first substrate. Likewise, the first zone of the second substrate would endpoint at an expected index E13 less (and thus a thickness greater) than the first zone of the first substrate.

If, as shown in FIG. 11, the target index will be reached at different times for different substrates (or equivalently, the adjustable zones will have different expected indexes at the projected endpoint time of reference zone), the polishing rate can be adjusted upwardly or downwardly, such that the substrates would reach the target index (and thus target thickness) closer to the same time than without such adjustment, e.g., at approximately the same time, or would have closer to the same index value (and thus same thickness), at the target time than without such adjustment, e.g., approximately the same index value (and thus approximately the same thickness).

Thus, in the example of FIG. 10, commencing at a time T0, at least one polishing parameter for the second zone of the first substrate is modified so that the polishing rate of the zone is decreased (and as a result the slope of the index trace 220 is decreased). Also, in this example, at least one polishing parameter for the first zone of the second substrate is modified so that the polishing rate of the zone is decreased (and as a result the slope of the index trace 230 is decreased). Similarly, in this example, at least one polishing parameter for the second zone of the second substrate is modified so that the polishing rate of the zone is decreased (and as a result the slope of the index trace 240 is decreased). As a result both zones of both substrates would reach the target index (and thus the target thickness) at approximately the same time (or if polishing of both substrates halts at the same time, both zones of both substrates will end with approximately the same thickness).

In some implementations, if the projected index at the expected endpoint time ET indicate that a zone of the substrate is within a predefined range of the target thickness, then no adjustment may be required for that zone. The range may be 2%, e.g., within 1%, of the target index.

The polishing rates for the adjustable zones can be adjusted so that all of the zones are closer to the target index at the expected endpoint time than without such adjustment. For example, a reference zone of the reference substrate might be chosen and the processing parameters for all of the other zones adjusted such that all of the zones will endpoint at approximately the projected time of the reference substrate. The reference zone can be, for example, a predetermined zone, e.g., the center zone 148*a* or the zone 148*b* immediately surrounding the center zone, the zone having the earliest or latest projected endpoint time of any of the zones of any of the substrates, or the zone of a substrate having the desired projected endpoint. The earliest time is equivalent to the thinnest substrate if polishing is halted at the same time. Likewise, the latest time is equivalent to the thickest substrate if polishing is halted at the same time. The reference substrate can be, for example, a predetermined substrate, a substrate having the zone with the earliest or latest projected endpoint time of the substrates. The earliest time is equivalent to the thinnest zone if polishing is halted at the same time. Likewise, the latest time is equivalent to the thickest zone if polishing is halted at the same time.

For each of the adjustable zones, a desired slope for the index trace can be calculated such that the adjustable zone reaches the target index at the same time as the reference zone. For example, the desired slope SD can be calculated from I(IT−I)=SD*(TE−T0), where I is the index value (calculated from the linear function fit to the sequence of index values) at time T0 polishing parameter is to be changed, IT is the target index, and TE is the calculated expected endpoint time. In the example of FIG. 10, for the second zone of the first substrate, the desired slope SD2 can be calculated from (IT−I2)=SD2*(TE−T0), for the first zone of the second substrate, the desired slope SD3 can be calculated from (IT−I3)=SD3*(TE−T0), and for the second zone of the second substrate, the desired slope SD4 can be calculated from (IT−I4)=SD4*(TE−T0).

Referring to FIG. 11, in some implementations, there is no reference zone. For example, the expected endpoint time TE' can be a predetermined time, e.g., set by the user prior to the polishing process, or can be calculated from an average or other combination of the expected endpoint times of two or more zones (as calculated by projecting the lines for various zones to the target index) from one or more substrates. In this implementation, the desired slopes are calculated substantially as discussed above (using the expected endpoint time TE' rather than TE), although the desired slope for the first zone of the first substrate must also be calculated, e.g., the desired slope SD1 can be calculated from (IT−I1)=SD1*(TE−T0).

Figure 12:
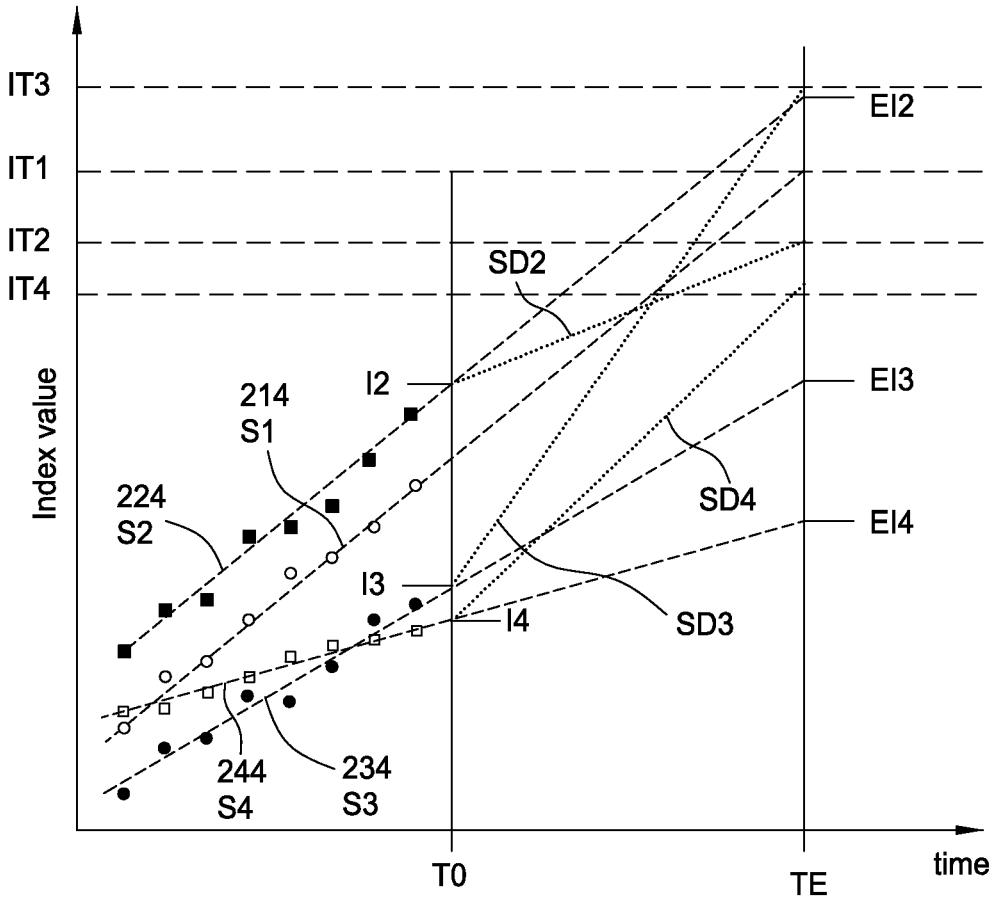
FIG. 12 illustrates a plurality of index traces for different zones of different substrates, with different zones having different target indexes.

Referring to FIG. 12, in some implementations, (which can also be combined with the implementation shown in FIG. 11), there are different target indexes for different zones. This permits the creation of a deliberate but controllable non-uniform thickness profile on the substrate. The target indexes can be entered by user, e.g., using an input device on the controller. For example, the first zone of the first substrate can have a first target indexes IT1, the second zone of the first substrate can have a second target indexes IT2, the first zone of the second substrate can have a third target indexes IT3, and the second zone of the second substrate can have a fourth target indexes IT4.

The desired slope SD for each adjustable zone can be calculated from (IT−I)=SD*(TE−T0), where I is the index value of the zone (calculated from the linear function fit to the sequence of index values for the zone) at time T0 at which the polishing parameter is to be changed, IT is the target index of the particular zone, and TE is the calculated expected endpoint time (either from a reference zone as discussed above in relation to FIG. 10, or from a preset endpoint time or from a combination of expected endpoint times as discussed above in relation to FIG. 11). In the example of FIG. 12, for the second zone of the first substrate, the desired slope SD2 can be calculated from (IT2−I2)=SD2*(TE−T0), for the first zone of the second substrate, the desired slope SD3 can be calculated from (IT3−I3)=SD3*(TE−T0), and for the second zone of the second substrate, the desired slope SD4 can be calculated from (IT4−I4)=SD4*(TE−T0).

For any of the above methods described above for FIGS. 10-12, the polishing rate is adjusted to bring the slope of index trace closer to the desired slope. The polishing rates can be adjusted by, for example, increasing or decreasing the pressure in a corresponding chamber of a carrier head. The change in polishing rate can be assumed to be directly proportional to the change in pressure, e.g., a simple Prestonian model. For example, for each zone of each substrate, where zone was polished with a pressure Fold prior to the time T0, a new pressure Pnew to apply after time T0 can be calculated as Pnew=Pold*(SD/S), where S is the slope of the line prior to time T0 and SD is the desired slope.

For example, assuming that pressure Pold1 was applied to the first zone of the first substrate, pressure Pold2 was applied to the second zone of the first substrate, pressure Pold3 was applied to the first zone of the second substrate, and pressure Pold4 was applied to the second zone of the second substrate, then new pressure Pnew1 for the first zone of the first substrate can be calculated as Pnew1=Pold1*(SD1/S1), the new pressure Pnew2 for the second zone of the first substrate clan be calculated as Pnew2=Pold2*(SD2/S2), the new pressure Pnew3 for the first zone of the second substrate clan be calculated as Pnew3=Pold3*(SD3/S3), and the new pressure Pnew4 for the second zone of the second substrate clan be calculated as Pnew4=Pold4*(SD4/S4).

The process of determining projected times that the substrates will reach the target thickness, and adjusting the polishing rates, can be performed just once during the polishing process, e.g., at a specified time, e.g., 40 to 60% through the expected polishing time, or performed multiple times during the polishing process, e.g., every thirty to sixty seconds. At a subsequent time during the polishing process, the rates can again be adjusted, if appropriate. During the polishing process, changes in the polishing rates can be made only a few times, such as four, three, two or only one time. The adjustment can be made near the beginning, at the middle or toward the end of the polishing process.

Polishing continues after the polishing rates have been adjusted, e.g., after time T0, and the optical monitoring system continues to collect spectra and determine index values for each zone of each substrate. Once the index trace of a reference zone reaches the target index (e.g., as calculated by fitting a new linear function to the sequence of index values after time T0 and determining the time at which the new linear function reaches the target index), endpoint is called and the polishing operation stops for both substrates. The reference zone used for determining endpoint can be the same reference zone used as described above to calculate the expected endpoint time, or a different zone (or if all of the zones were adjusted as described with reference to FIG. 10, then a reference zone can be selected for the purpose of endpoint determination).

Figure 13:
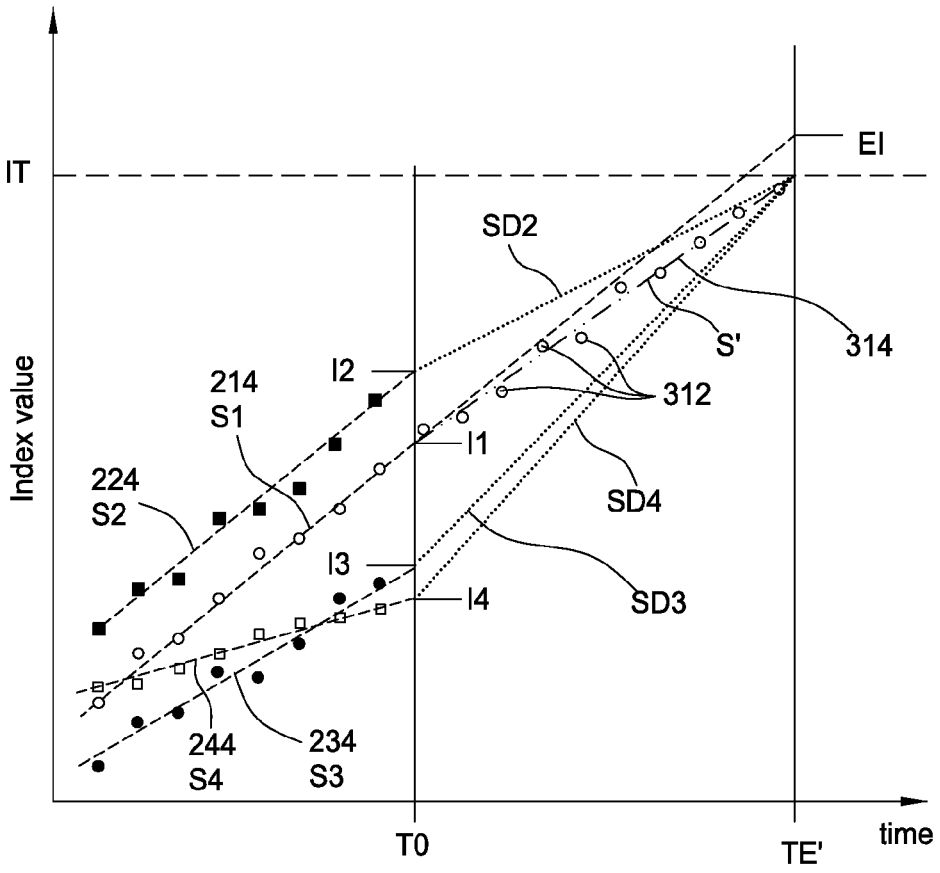
FIG. 13 illustrates a calculation of an endpoint for based on a time that an index trace of a reference zone reaches a target index.

For example, as shown in FIG. 13, after time T0, the optical monitoring system continues to collect spectra for the reference zone and determine index values 312 for the reference zone. If the pressure on the reference zone did not change (e.g., as in the implementation of FIG. 10), then the linear function can be calculated using data points from both before T0 and after T0 to provide an updated linear function 314, and the time at which the linear function 314 reaches the target index IT indicates the polishing endpoint time. On the other hand, if the pressure on the reference zone changed at time T0 (e.g., as in the implementation of FIG. 11), then a new linear function 314 with a slope S' can be calculated from the sequence of index values 312 after time T0, and the time at which the new linear function 314 reaches the target index IT indicates the polishing endpoint time. The reference zone used for determining endpoint can be the same reference zone used as described above to calculate the expected endpoint time, or a different zone (or if all of the zones were adjusted as described with reference to FIG. 10, then a reference zone can be selected for the purpose of endpoint determination). If the new linear function 314 reaches the target index IT slightly later (as shown in FIG. 13) or earlier than the projected time calculated from the original linear function 214, then one or more of the zones may be slightly overpolished or underpolished, respectively. However, since the difference between the expected endpoint time and the actual polishing time should be less a couple seconds, this need not severely impact the polishing uniformity.

Even with the adjustment of the polishing rates as described above with reference to FIG. 10, it is still possible that the actual polishing rate of one or more adjustable zones may not match the desired polishing rate, and thus that adjustable zone may be underpolished or overpolished. In some implementations, a feedback process can be used to correct the polishing rate of the adjustable zones based on the results of polishing of the adjustable zones in previous substrates. The mismatch between the desired polishing rate and the actual polishing rate can be due to process drift, e.g., changes in process temperature, pad condition, slurry composition, or variations in the substrates. In addition, a relationship between pressure change and removal rate change is not always initially well characterized for a given set of process conditions. Therefore, a user will typically run a design of experiment matrix to see the affect of different pressures in various zones on removal rate, or run a series substrates using in-situ process control, tweaking the gain and/or offset settings substrates by substrate the until the desired profile is achieved. However, a feedback mechanism can automatically determine or fine tune this relationship.

In some implementations, the feedback can be an error value based on measurements of an adjustable zone of one or more prior substrates. The error value can be used in the calculation of the desired pressure for an adjustable zone (i.e., other than a reference zone) of a subsequent substrate. The error value can be calculated based on the desired polishing rate (e.g., as represented by the calculated slope SD) and the actual polishing rate after the adjustment, e.g., after T0 (e.g., as represented by the actual slope S'). The error value can be used as a scaling factor to adjust the modification to the pressure on the adjustable zone. For this implementation, the optical monitoring system continues to collect spectra and determine index values for at least one adjustable zone, e.g., each adjustable zones of each substrate, after the adjustment of polishing pressures, e.g., after T0. However, implementations which use this feedback technique can also be applicable where only a single substrate is being polishing on the polishing pad at one time.

In one implementation, the adjusted pressure Padj to apply to an adjustable zone on a substrate after time T0 when the correction is made, is calculated according to $$P\text{adj}=(P\text{new}-P\text{old})*\text{err}+P\text{new},$$

where Fold was the pressure applied to the zone before time T0, Pnew is calculated as Pnew=Pold*(SD/S), and err is an error value calculated based on the variation of the actual polishing rate of the zone of one or more prior substrates from the desired polishing rate for the zone of those prior substrates.

FIGS. 14A-14D illustrate four situations in which the desired polishing rate for adjustable zone (as represented by the calculated slope SD from the linear function before T0) does not match the actual polishing rate of the adjustable zone (as represented by the actual slope S' from the second linear function after T0). In each of these situations, a sequence of spectra can be measured for the reference zone, index values 212 (for before time T0) and index values 312 (for after time T0) can be determined for the spectra from the reference zone, a linear function 214/314 can be fit to the index values 212 and 312, and the endpoint time TE' can be determined from the time that that the linear function 214/314 crosses the target index IT. In certain implementations, the projected endpoint time TE' may be the projected bulk endpoint time ($TE'_B$) of the projected residual clearing endpoint time ($TE'_R$) In addition, a sequence of spectra can be measured for at least one adjustable zone, e.g., index values 222 (for before time T0) and index values 322 (for after time T0) can be determined for the spectra, a first linear function 224 can be fit to the index values 222 to determine the original slope S for the adjustable zone for before time T0, a desired slope SD for the adjustable zone can be calculated as discussed above, and a second linear function 324 can be fit to the index values 322 to determine the actual slope S' for the adjustable zone after time T0. In some implementations, each adjustable zone of each substrate is monitored and an original slope, a desired slope and an actual slope is determined for each adjustable zone.

Figure 14A:
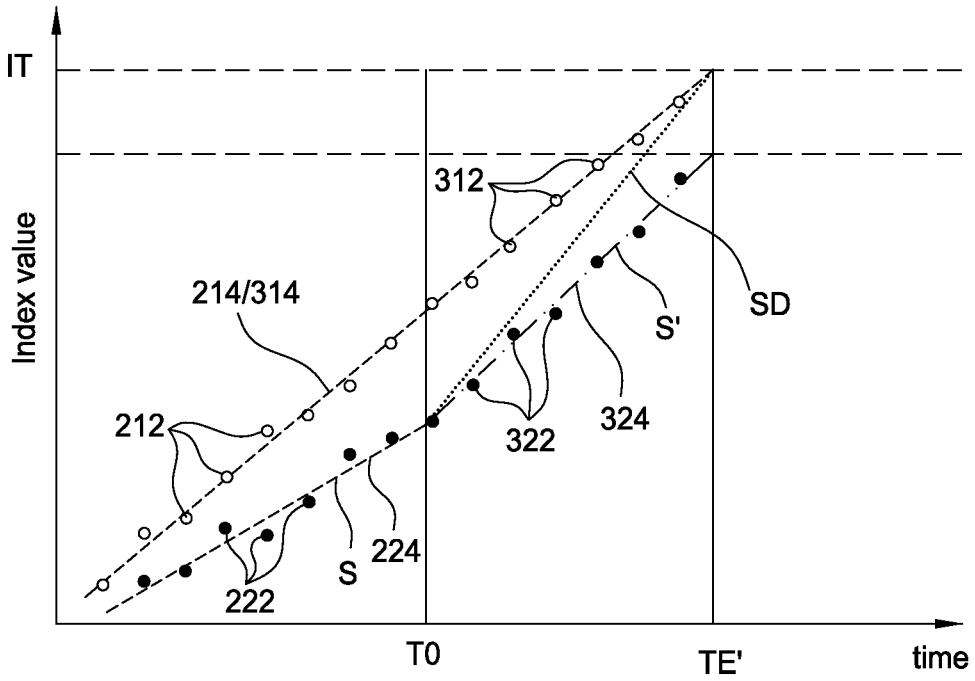
FIGS. 14A-14D illustrate a comparison of a desired slope to an actual slopes in four situations for the purpose of generating an error feedback.

As shown by FIG. 14A, in some situations, the desired slope SD can exceed the original slope S, but the actual slope S' for the adjustable zone can be less than the desired slope SD. Thus, assuming that the reference zone reaches the target index IT at the projected time, the adjustable zone of the substrate is underpolished, since it did not reach the target index by the endpoint time TE'. Because the actual polishing rate S' was less than the desired polishing rate SD for this adjustable zone for this substrate, for a subsequent substrate, the pressure for this adjustable zone should be increased more than the calculation of SD would otherwise indicate. For example, the error err can be calculated as err=[(SD−S')/SD].

Figure 14B:
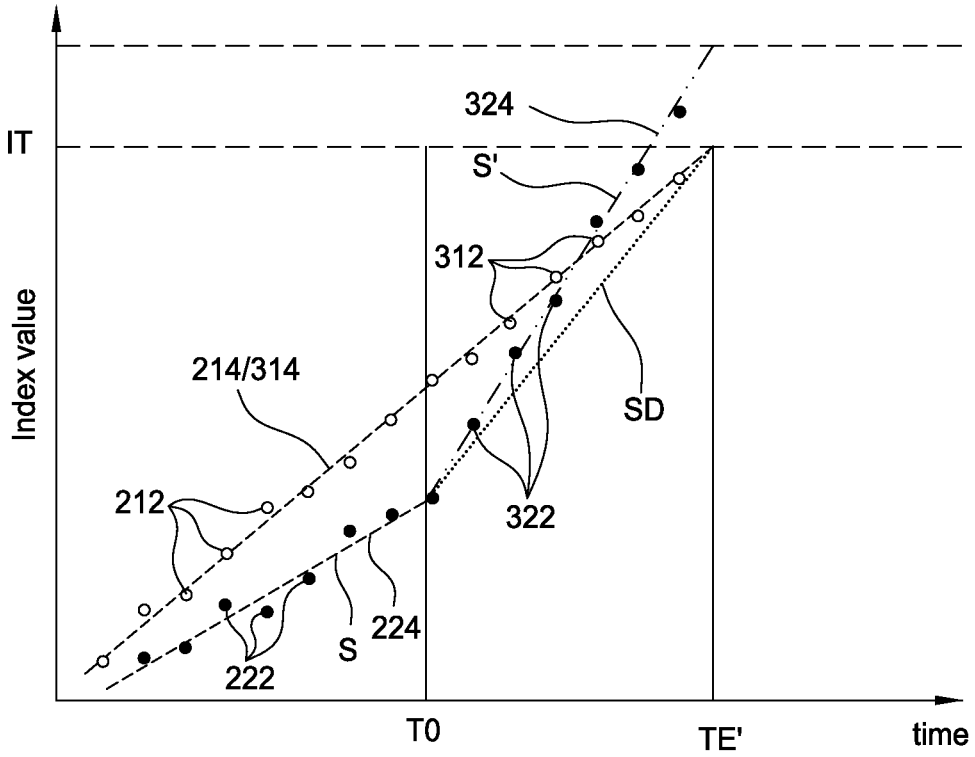

As shown by FIG. 14B, in some situations, the desired slope SD can exceed the original slope S, and the actual slope S' for the adjustable zone can be greater than the desired slope SD. Thus, assuming that the reference zone reaches the target index IT at the projected time, the adjustable zone of the substrate is overpolished, since it exceeded the target index at the endpoint time TE'. Because the actual polishing rate S' was greater than the desired polishing rate SD for this adjustable zone for this substrate, for a subsequent substrate, the pressure for this adjustable zone should be increased less than the calculation of SD would otherwise indicate. For example, the error err can be calculated as err=[(SD−S')/SD].

Figure 14C:
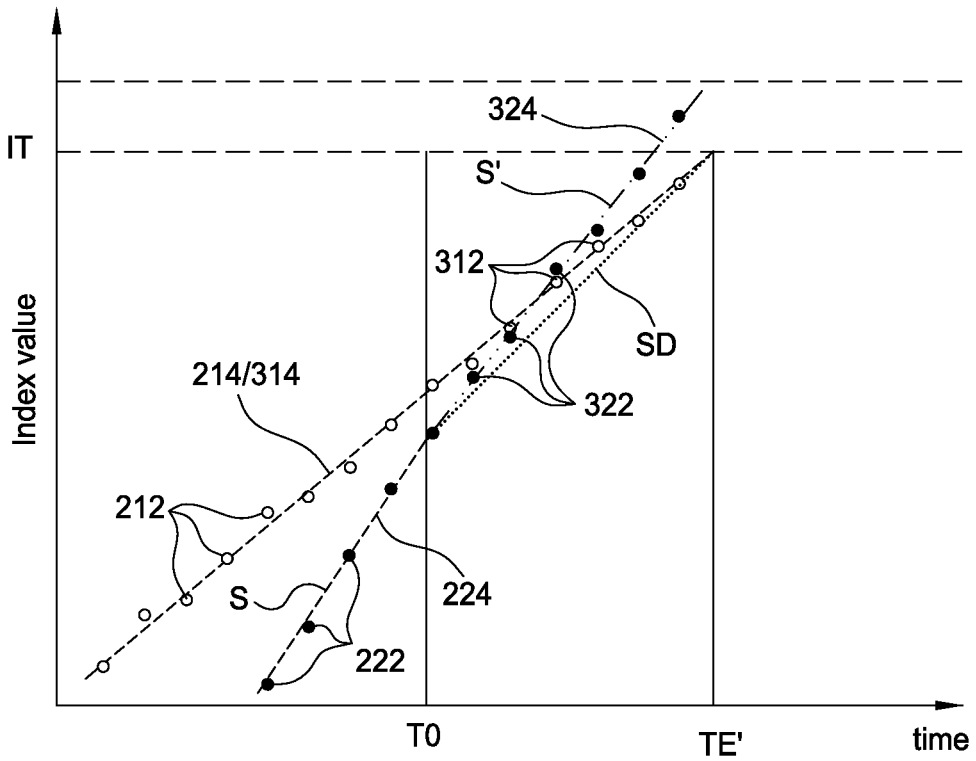

As shown by FIG. 14C, in some situations, the desired slope SD can be less than the original slope S, and the actual slope S' for the adjustable zone can be greater than the desired slope SD. Thus, assuming that the reference zone reaches the target index IT at the projected time, the adjustable zone of the substrate is overpolished, since it exceeded the target index at the endpoint time TE'. Because the actual polishing rate S' was greater than the desired polishing rate SD for this adjustable zone for this substrate, for a subsequent substrate, the pressure for this adjustable zone should be decreased more than the calculation of SD would otherwise indicate. For example, the error err can be calculated as err=[(S'−SD)/SD].

Figure 14D:
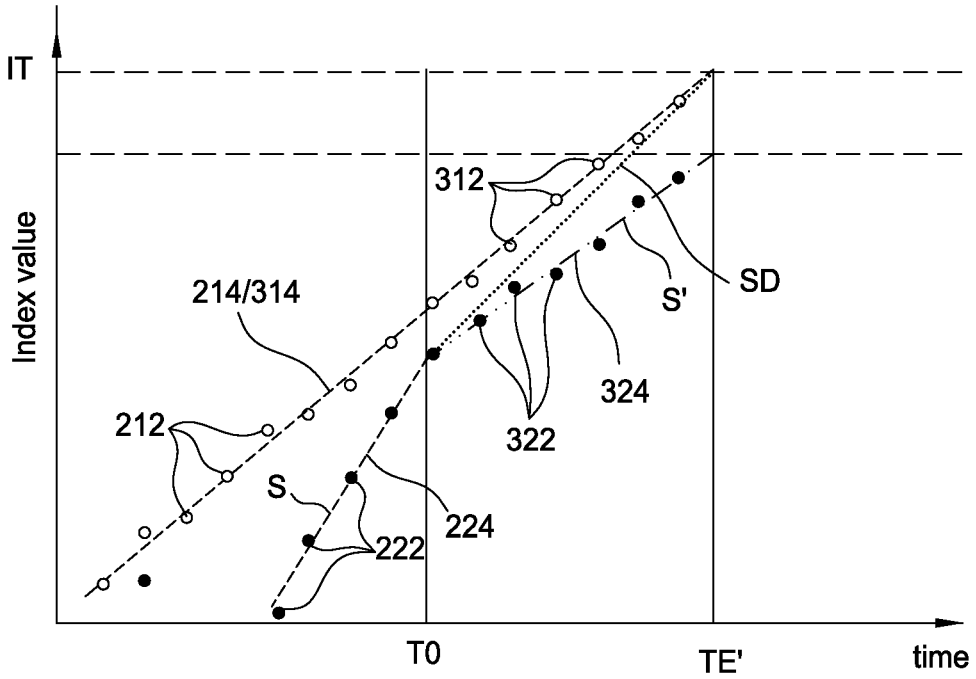

As shown by FIG. 14D, in some situations, the desired slope SD can be less than the original slope S, and the actual slope S' for the adjustable zone can be less than the desired slope SD. Thus, assuming that the reference zone reaches the target index IT at the projected time, the adjustable zone of the substrate is overpolished, since it did not reach the target index at the endpoint time TE'. Because the actual polishing rate S' was less than the desired polishing rate SD for this adjustable zone for this substrate, for a subsequent substrate, the pressure for this adjustable zone should be decreased less than the calculation of SD would otherwise indicate. For example, the error err can be calculated as err=[(S'−SD)/SD].

The implementations discussed above for FIGS. 14A-14D reverse the sign of the error for the situations shown in FIGS. 14C and 14D as compared to FIGS. 14A and 14B. That is, the error signal is reversed when the desired slope SD is greater than the original slope S (i.e., reversed as compared to when the desired slope SD is less than the original slope S).

However, in some implementations, the error can always be calculated in the same manner, err=[(SD−S')/SD]. In these implementations, if the desired slope is greater than the actual slope, then the error is positive, and if the desired slope is less than the actual slope, then the error is negative, regardless of the original slope S.

In some implementations, in each of the cases of FIGS. 14A-14D, the error err calculated for a prior substrate can then be used in the calculation of Padj=(Pnew−Pold)*err+Pnew [Equation 1] for the subsequent substrate.

Figure 15:
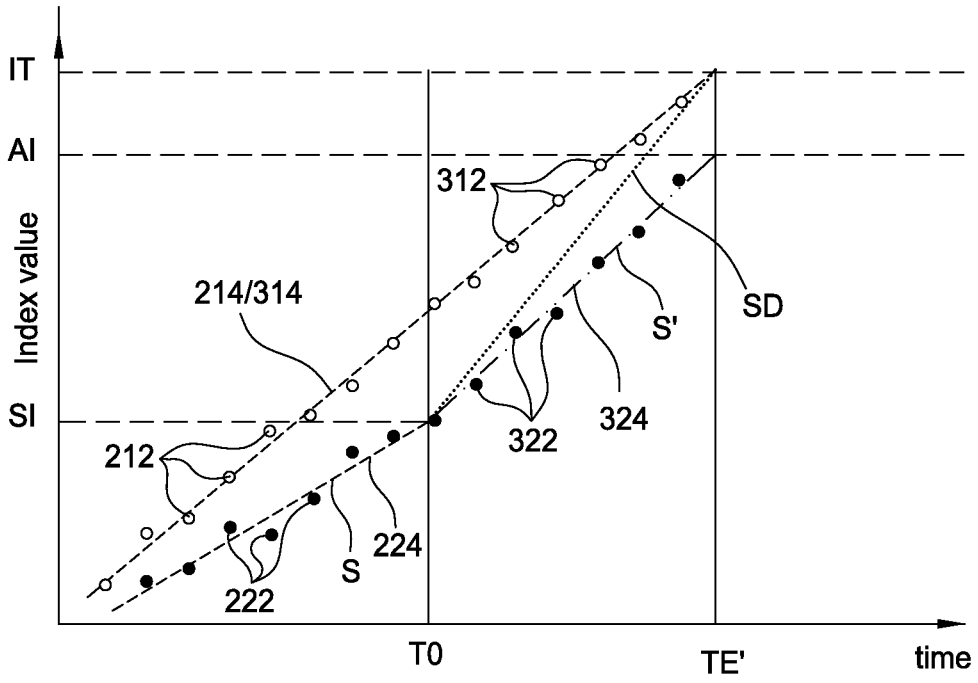
FIG. 15 illustrates a comparison of a target index to an actual index reached by an adjustable zone.
Figure 16A:
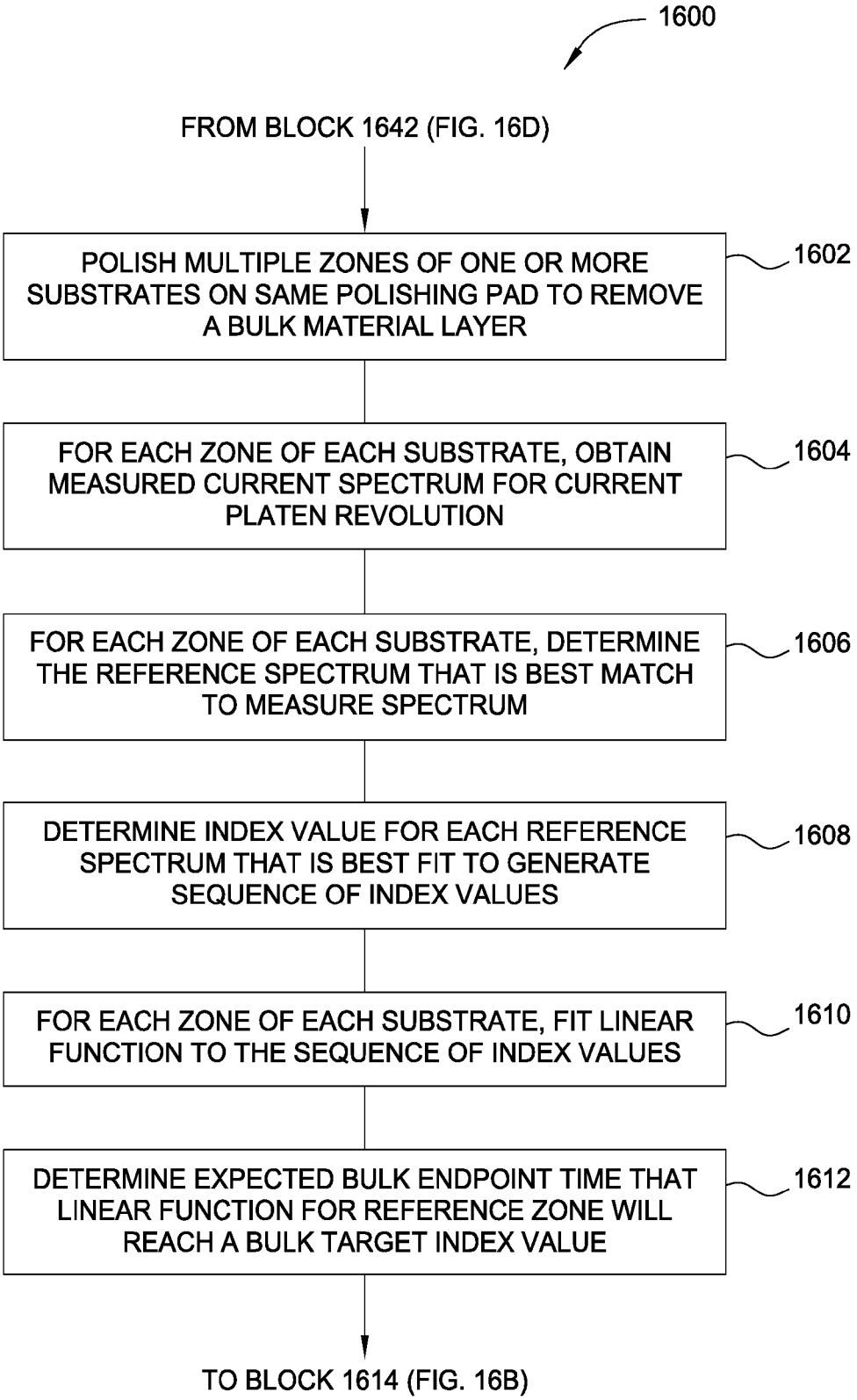
FIGS. 16A-16D is a flow diagram of one implementation of an exemplary process for adjusting the polishing rate of a plurality of zones of one or more substrates such that the plurality of zones have approximately the same thickness at a target time.
Figure 16B:
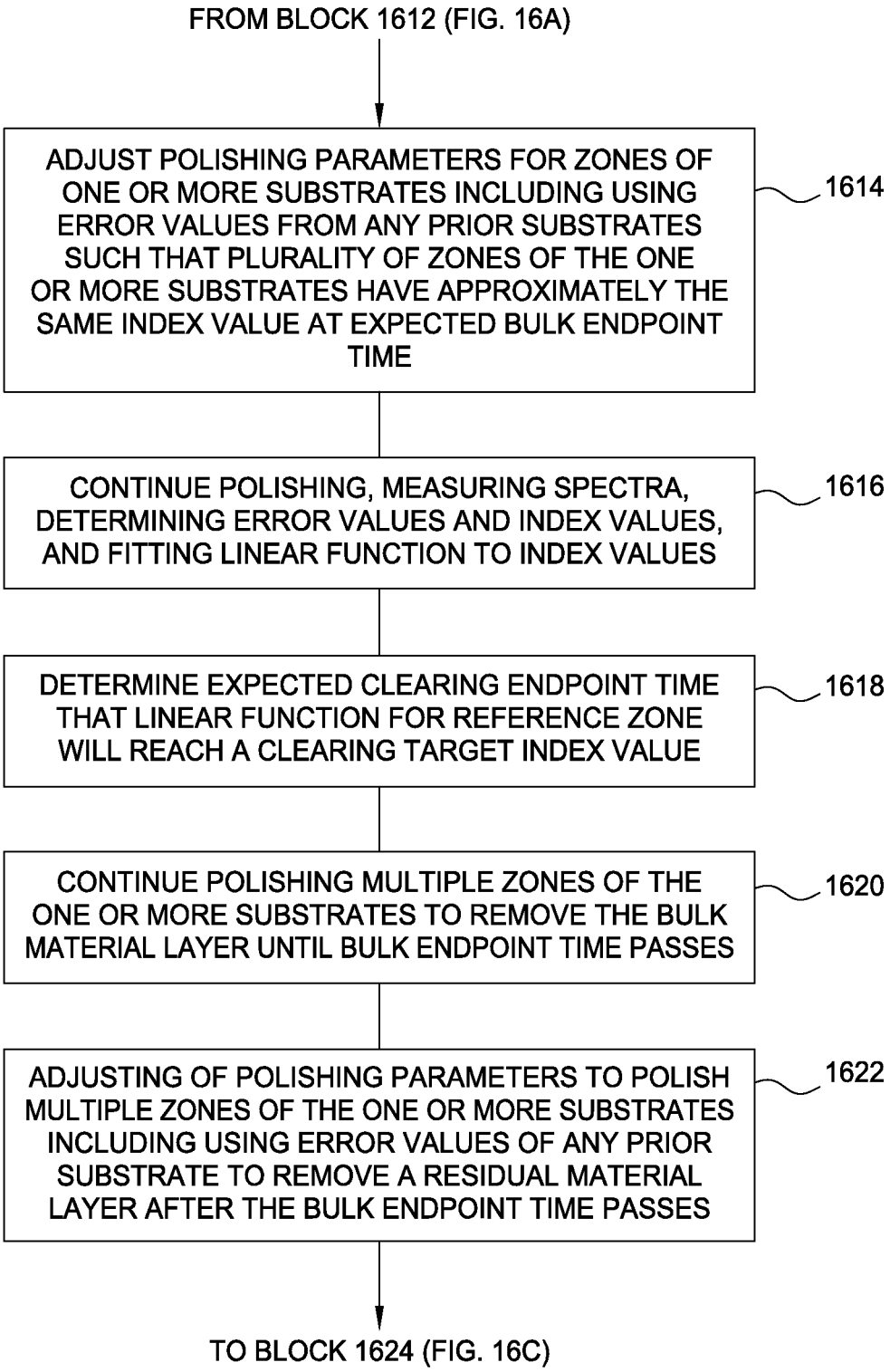
Figure 16C:
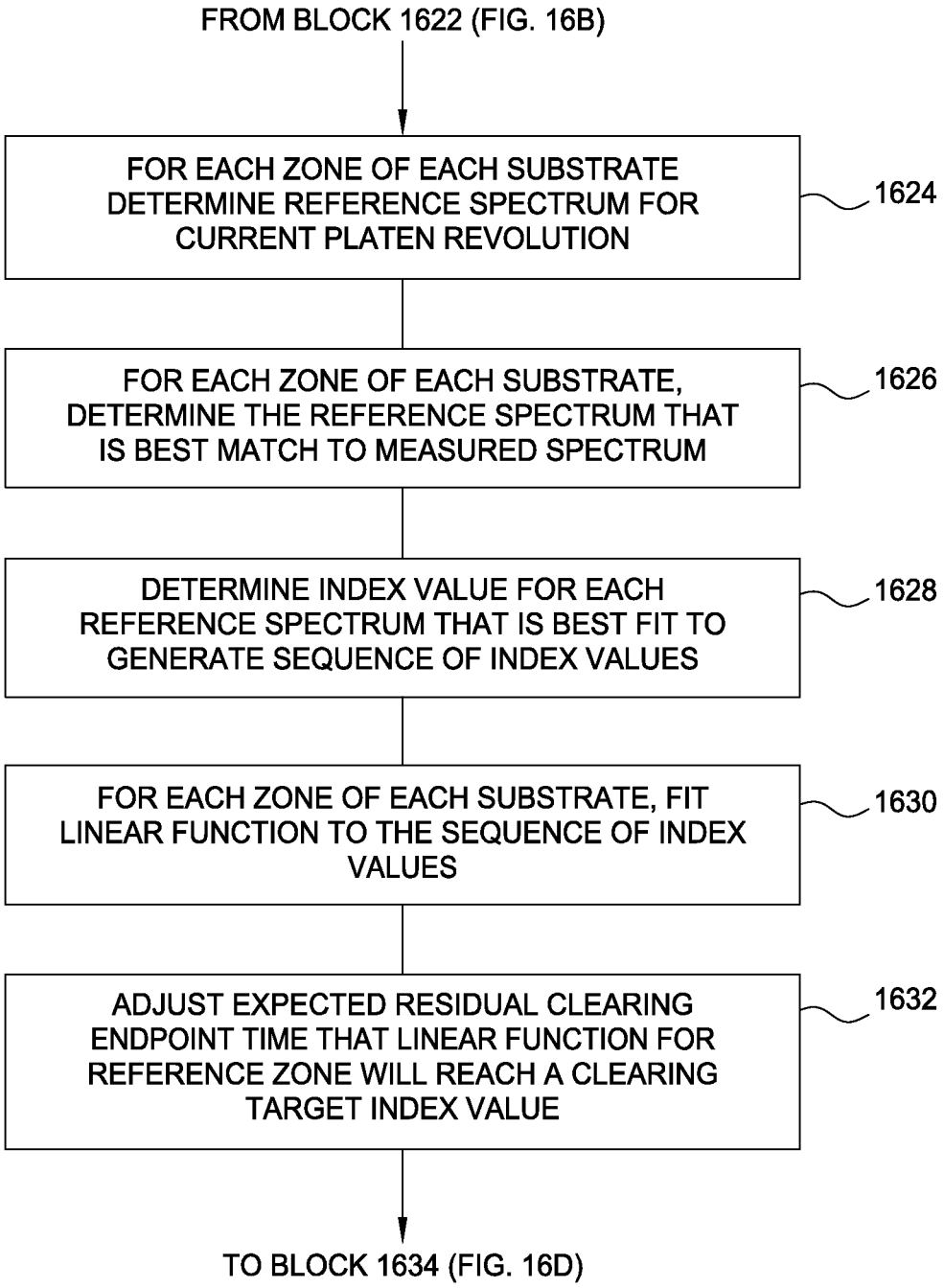
Figure 16D:
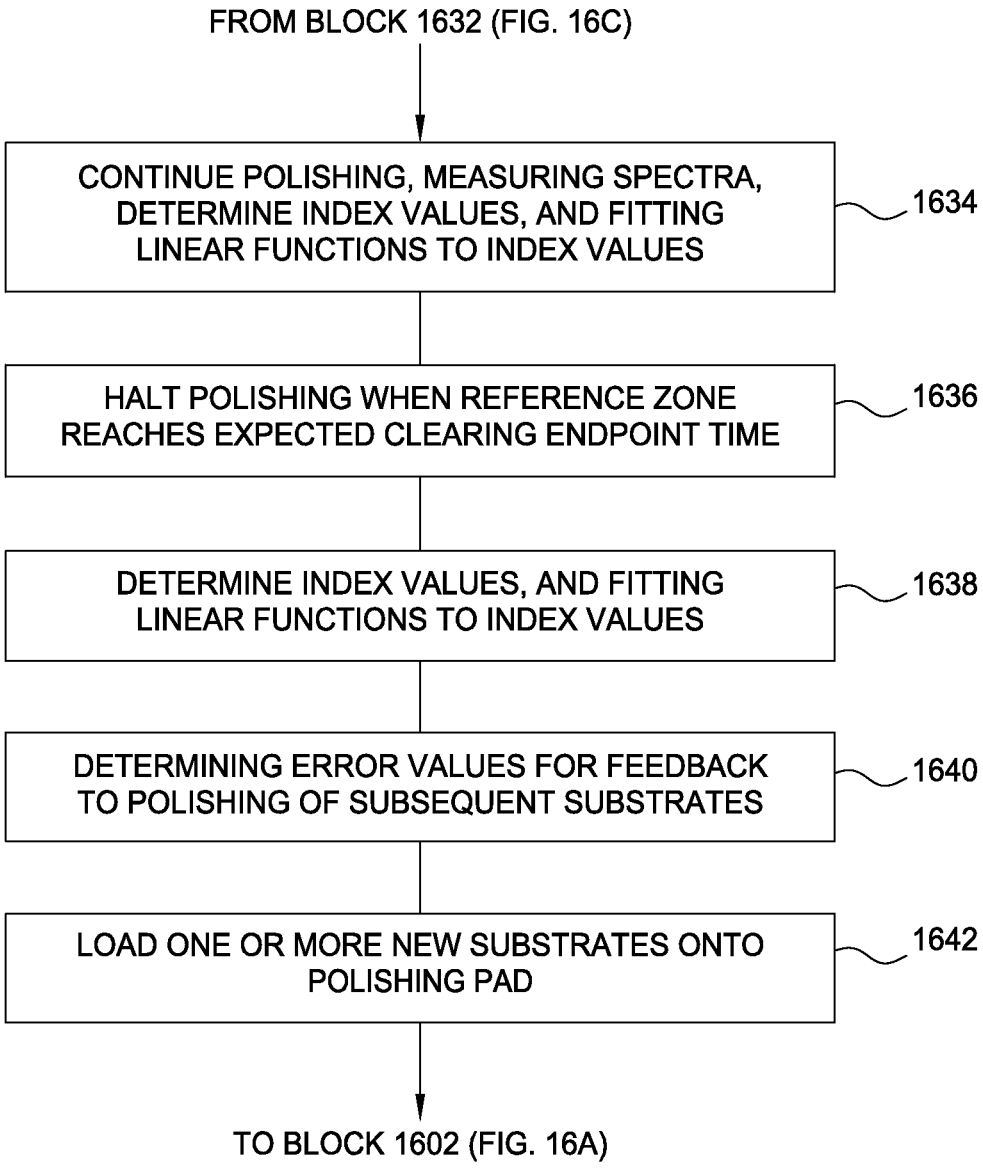

It can also be noted that rather than apply an error in the calculation of the adjusted pressure, an adjusted target index for the adjustable zone can be calculated. The desired slope would then be calculated based on the adjusted target index. For example, referring to FIG. 15, the adjusted target index ITadj can be calculated as ITadj=SI+(IT−SI)*(1+err), [Equation 2] where IT is the target index, and SI is the starting index at time T0 (as calculated from the linear function 224 or the linear function 324). The error err can be calculated as err=[(IT−AI)/(IT−SI)], where AI is the actual index reached by the adjustable zone at the endpoint time TE' (as calculated from the linear function 324).

In some implementations, applicable to the implementations of both FIGS. 14A-D and FIG. 15, the error is the accumulated over several prior substrates. In a simple implementation, the total error err used in the calculation for either equation 1 or equation 2 is calculated err=k1*err1+k2*err2, where k1 and k2 are constants, err1 is the error calculated from the immediately previous substrate, and err2 are the error calculated for one or more substrates before the previous substrate.

In some implementations, the applied error err used in the calculation for either equation 1 or equation 2 for the present substrate is calculated as a combination of the scaled error of the previous substrate and a weighted average of the applied error from substrates before the previous substrate. This can be expressed as by the following equations:

$$\text{applied err}_{x+1}=\text{scaled error}_{x+total}\text{error}_{x-1}$$

$$\text{scaled error}_x=k1*\text{err}_x \text{ and}$$

$$\text{total error}_{x-1}=k2*(a1*\text{applied err}_{x-2}+a2*\text{applied err}_{x-3}\ldots aN*\text{applied err}_{(x-(N+1)}$$

where k1 and k2 are constants, and a1, a2, aN are constants for a weighted average, i.e., a1+a2+ . . . +aN=1. The constant k1 can be about 0.7, and the constant k2 can be 1. $\text{Err}_x$ is the error calculated for the previous substrate according to one of the above approaches, e.g., $\text{err}_x$=[(SD−S')/SD] or $\text{err}_x$=[(S'−SD)/SD] for the implementations of FIGS. 14A-14D, or $\text{err}_x$=[(IT−AI)/(IT−SI)] for the implementation of FIG. 15. The term applied $\text{err}_x$ is the applied error for the previous substrate, e.g., assuming the present substrate is substrate X+1, then applied $\text{err}_{x-2}$ is the applied error for the third previous substrate, applied $\text{err}_{x-2}$ is the applied error for the fourth previous substrate, etc. For either Equation 1 or Equation 2, err=applied $\text{err}_{x+1}$.

In some implementations, e.g., for copper polishing, after detection of the endpoint for a substrate, the substrate is immediately subjected to an overpolishing process, e.g., to remove copper residue. The overpolishing process can be at a uniform pressure for all zones of the substrate, e.g., 1 to 1.5 psi. The overpolishing process can have a preset duration, e.g., 10 to 15 seconds.

In some implementations, polishing of the substrates does not halt simultaneously. In such implementations, for the purpose of the endpoint determination, there can be a reference zone for each substrate. Once the index trace of a reference zone of a particular substrate reaches the target index (e.g., as calculated by the time the linear function fit the sequence of index values after time T0 reaches the target index), endpoint is called for the particular substrate and application of pressure to all zones of the particular is halted simultaneously. However, polishing of one or more other substrates can continue. Only after endpoint has been called for the all of the remaining substrates (or after overpolishing has been completed for all substrates), based on the reference zones of the remaining substrates, does rinsing of the polishing pad commence. In addition, all of the carrier heads can lift the substrates off the polishing pad simultaneously.

Where multiple index traces are generated for a particular zone and substrate, e.g., one index trace for each library of interest to the particular zone and substrate, then one of the index traces can be selected for use in the endpoint or pressure control algorithm for the particular zone and substrate. For example, the each index trace generated for the same zone and substrate, the controller 190 can fit a linear function to the index values of that index trace, and determine a goodness of fit of the that linear function to the sequence of index values. The index trace generated having the line with the best goodness of fit its own index values can be selected as the index trace for the particular zone and substrate. For example, when determining how to adjust the polishing rates of the adjustable zones, e.g., at time T0, the linear function with the best goodness of fit can be used in the calculation. As another example, endpoint can be called when the calculated index (as calculated from the linear function fit to the sequence of index values) for the line with the best goodness of fit matches or exceeds the target index. Also, rather than calculating an index value from the linear function, the index values themselves could be compared to the target index to determine the endpoint.

Determining whether an index trace associated with a spectra library has the best goodness of fit to the linear function associated with the library can include determining whether the index trace of the associated spectra library has the least amount of difference from the associated robust line, relatively, as compared to the differences from the associated robust line and index trace associated with another library, e.g., the lowest standard deviation, the greatest correlation, or other measure of variance. In one implementation, the goodness of fit is determined by calculating a sum of squared differences between the index data points and the linear function; the library with the lowest sum of squared differences has the best fit.

FIGS. 16A-16D is a flow diagram 1600 of one implementation of an exemplary process for adjusting the polishing rate of a plurality of zones of one or more substrates such that the plurality of zones have approximately the same thickness at a target time. At block 1602, a plurality of zones of one or more substrates are polished in a polishing apparatus simultaneously with the same polishing pad to remove a bulk material layer as described above. During this polishing operation, each zone of each substrate has its polishing rate controllable independently of the other substrates by an independently variable polishing parameter, e.g., the pressure applied by the chamber in carrier head above the particular zone. Exemplary bulk materials include conductive materials, such as copper, and insulators such as silicon nitride (SiN) and silicon oxides (e.g., $SiO_2$). At block 1604 during the polishing operation, the substrates are monitored as described above, e.g., with a measured spectrum obtained from each zone of each substrate. At block 1606, the reference spectrum that is the best match is determined. At block 1608, the index value for each reference spectrum that is the best fit is determined to generate a sequence of index values. At block 1610, for each zone of each substrate, a first linear function is fit to the sequence of index values.

At block 1612, an expected bulk endpoint time that the first linear function for the reference zone will reach a bulk target index value is determined, e.g., by linear interpolation of the linear function. In certain implementations, the expected bulk endpoint time is predetermined or calculated as a combination of expected endpoint times of multiple zones. In certain implementations, the bulk endpoint time may be detected using at least one of a motor torque monitoring system, an eddy current monitoring system, a friction monitoring system, or a monochromatic optical system as previously described herein. In certain implementations, the bulk endpoint time of previously polished substrates may be used to estimate the bulk endpoint time. In certain implementations, where multiple polishing steps are used to remove the bulk material, the endpoint time may occur after a portion of the bulk material is removed.

At block 1614, the polishing parameters for the other zones of the one or more substrates are adjusted to adjust the polishing rate of that substrate such that the plurality of zones of the one or more substrates reach the target thickness at approximately the same time or such that the plurality of zones of the plurality of substrates have approximately the same thickness (or a target thickness) at the expected bulk endpoint time. The process of adjusting the polishing parameter can include using an error value generated from any previous substrate. A description of the adjustment of polishing parameters including the use of error values is described in commonly assigned United States Patent Application Publication No. 2012/0231701 to Qian et al, titled FEEDBACK FOR POLISHING RATE CORRECTION IN CHEMICAL MECHANICAL POLISHING.

At block 1616, polishing continues after the parameters are adjusted, and for each zone of each substrate, measuring a spectrum, determining the best matching reference spectrum from a library, determining the index value for the best matching spectrum to generate a new sequence of index values for the time period after the polishing parameter has been adjusted, and fitting a second linear function to new sequence of index values.

In certain implementations, for each adjustable zone, the slope of the second linear function fit to the new sequence of index values of that zone (i.e., after the parameters are adjusted) is determined. In certain implementations, for each adjustable zone, an error value is calculated based on the difference between the actual polishing rate (as given by the slope of the second linear function) and the desired polishing rate (as given by the desired slope) for that zone. The polishing parameters may be adjusted using the error value and the adjusted polishing parameters may be used during removal of the residual material from the one or more substrates in a feed-forward type process and also may be applied to the polishing of additional substrates in a feed-back type process.

Optionally, the polishing can be halted once the index value for a reference zone (e.g., a calculated index value generated from the first or second linear function) reaches a first target index value. In certain implementations, the first target index value is the target index value of the bulk polishing process. In certain implementations where polishing is performed on multiple platens (e.g., a first platen for the removal of bulk material and a second platen for the removal of residual material), the one or more substrates may optionally be transferred to second polishing station having a second platen and second polishing pad where polishing and removal of the residual material is performed. A multiple platen polishing system is described in commonly assigned U.S. Pat. No. 6,126,517, to Tolles et al., titled SYSTEM FOR CHEMICAL MECHANICAL POLISHING HAVING MULTIPLE POLISHING STATIONS. In certain implementations, removal of the residual material may be performed using a polishing solution which differs from the polishing solution used to remove the bulk material layer. In certain implementations were polishing is performed on a single platen, bulk material removal and residual material removal may be performed on the same platen using the same polishing pad.

At block 1618 an expected clearing endpoint time that the linear function for the reference zone will reach a clearing target index value is determined, e.g., by linear interpolation of the linear function. In certain implementations, the clearing endpoint time is an endpoint of the residual material removal polishing process. In certain implementations, the expected clearing endpoint time is predetermined or calculated as a combination of expected endpoint times of multiple zones. In certain implementations, the clearing endpoint time may be detected using at least one of a motor torque monitoring system, an eddy current monitoring system, a friction monitoring system, or a monochromatic optical system as previously described herein. In certain implementations, the clearing endpoint time may be estimated based on the clearing endpoint times of previous substrates.

At block 1620 continue polishing the multiples zones of the one or more substrates to remove the bulk material layer until a bulk endpoint time passes.

At block 1622, the polishing parameters are adjusted to polish multiple zones of the one or more substrates to remove a residual material layer after the bulk endpoint time passes. The process of adjusting the polishing parameters can include using an error value generated from any previous substrate. Adjusting the polishing parameters may include adjusting the pressure applied to each zone. The adjusted polishing parameters may be based on factors including the expected clearing endpoint time, error values obtained from any previous substrate, error values obtained from the bulk polish of the same substrate (e.g., a feed-forward process), the adjusted polishing parameters obtained in block 1614, and the thickness of material on the one or more substrates. Similar to the polishing process of block 1602, during this polishing operation, each zone of each substrate has its polishing rate controllable independently of the other substrates by an independently variable polishing parameter, e.g., the pressure applied by the chamber in carrier head above the particular zone. In certain implementations, the polishing process of block 1622 is performed at a reduced pressure in comparison to the polishing process of block 1602. The polishing process of block 1622 may be performed on the same platen using the same polishing pad as the polishing process of block 1602 or the polishing process of block 1622 may be performed on a separate platen using a different polishing pad and/or different polishing solution.

At block 1624, similar to the process of block 1604, a reference spectrum is determined for the current platen revolution for each zone of each substrate. At block 1626, similar to block 1606, the reference spectrum that is the best match is determined. At block 1628, similar to block 1608, the index value for each reference spectrum that is the best fit is determined to generate sequence of index values. At block 1630, similar to block 1610, for each zone of each substrate, a first linear function is fit to the sequence of index values.

At block 1632, in certain implementations, the expected clearing endpoint time may be adjusted based on the first linear function for a reference zone will reach a target index value is determined, e.g., by linear interpolation of the linear function. At block 1634, polishing continues after the parameters are adjusted, and for each zone of each substrate, measuring a spectrum, determining the best matching reference spectrum from a library, determining the index value for the best matching spectrum to generate a new sequence of index values for the time period after the polishing parameter has been adjusted, and fitting a second linear function to new sequence of index values.

At block 1636, the polishing can be halted once the index value for a reference zone (e.g., a calculated index value generated from the first or second linear function) reaches a clearing target index value. In certain implementations, the clearing target index value is the target index value of the residual polishing process. At block 1638, for each adjustable zone, the slope of the second linear function fit to the new sequence of index values of that zone (i.e., after the parameters are adjusted) is determined. At block 1640, for each adjustable zone, an error value is calculated based on the difference between the actual polishing rate (as given by the slope of the second linear function) and the desired polishing rate (as given by the desired slope) for that zone. At block 1642, at least one new substrate is loaded onto the polishing pad, and the process repeats, with the adjustment to the polishing parameters previously calculated.

Figure 17:
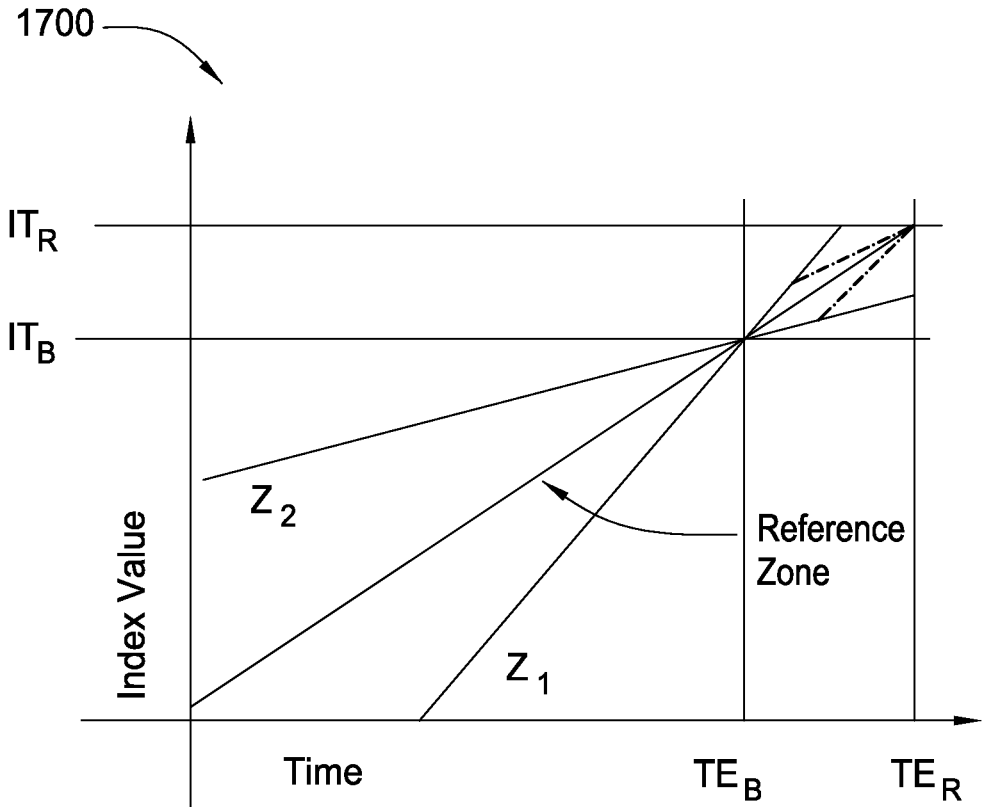
FIG. 17 is a plot depicting a method of polishing a substrate according to implementations described herein.

FIG. 17 is a plot 1700 depicting a method of polishing a substrate according to implementations described herein. Similar to FIG. 1, the x-axis represents time and the y-axis represents the index value of the material being removed from the substrate. $IT_B$ represents the index value of the target thickness of the bulk polishing process. $IT_R$ represents the index value of the target thickness of the residual polishing process. $Z_1$ and $Z_2$ represent separate zones of the substrate surface. $TE_B$ represents the polishing endpoint for the bulk polishing process and $TE_R$ represents the polishing endpoint for the residual polishing process. Although two zones ($Z_1$ and $Z_2$) are depicted, as discussed above the substrate may be divided into any number of zones. The Reference Zone depicts the desired polishing profile. The polishing process depicted in plot 1700 targets a uniform polishing profile at the intersection of $IT_B$ and $TE_B$. Similar to the prior art polishing process depicted in FIG. 1, the correction of polishing pressures used during the bulk polishing process leads to over-correction and over-polishing during the residue clearing process between $IT_B$ and $IT_R$. However, using the implementations described herein, the polishing pressures of $Z_1$ and $Z_2$ are corrected during the residue clearing process to achieve a uniform polishing profile at the end of the residual clearing process shown by the intersection of $IT_R$ and $TE_R$.

Figure 18:
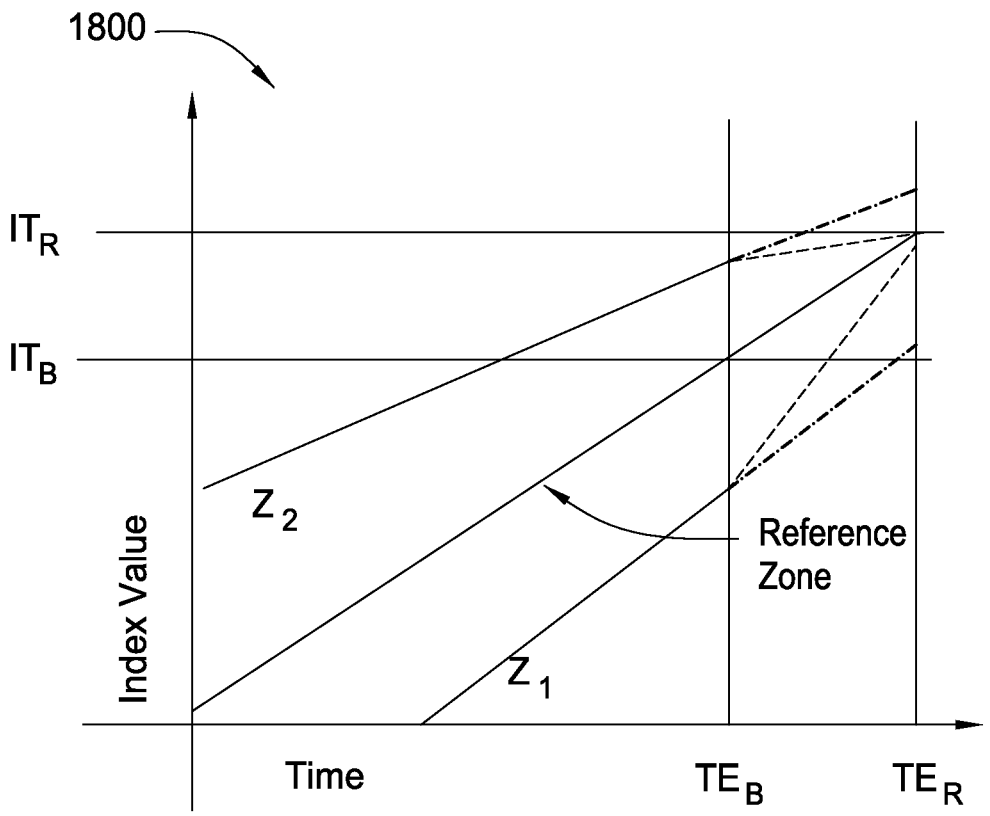
FIG. 18 is a plot depicting another method of polishing a substrate according to implementations described herein.

FIG. 18 is a plot 1800 depicting another method of polishing a substrate according to implementations described herein. The polishing process depicted in plot 1800 targets a uniform polishing profile at the intersection of $IT_R$ and $TE_R$. The method of polishing depicted in plot 1800 may correspond to method of flow diagram 1600. The polishing parameters used for Z1 and Z2 are adjusted based on a clearing recipe calculated prior to the bulk endpoint at the intersection of $TE_B$ and $IT_B$ as described in flow diagram 1600 to achieve a uniform polishing profile at the end of the residual clearing process shown by the intersection of $IT_R$ and $TE_R$.

Figure 19:
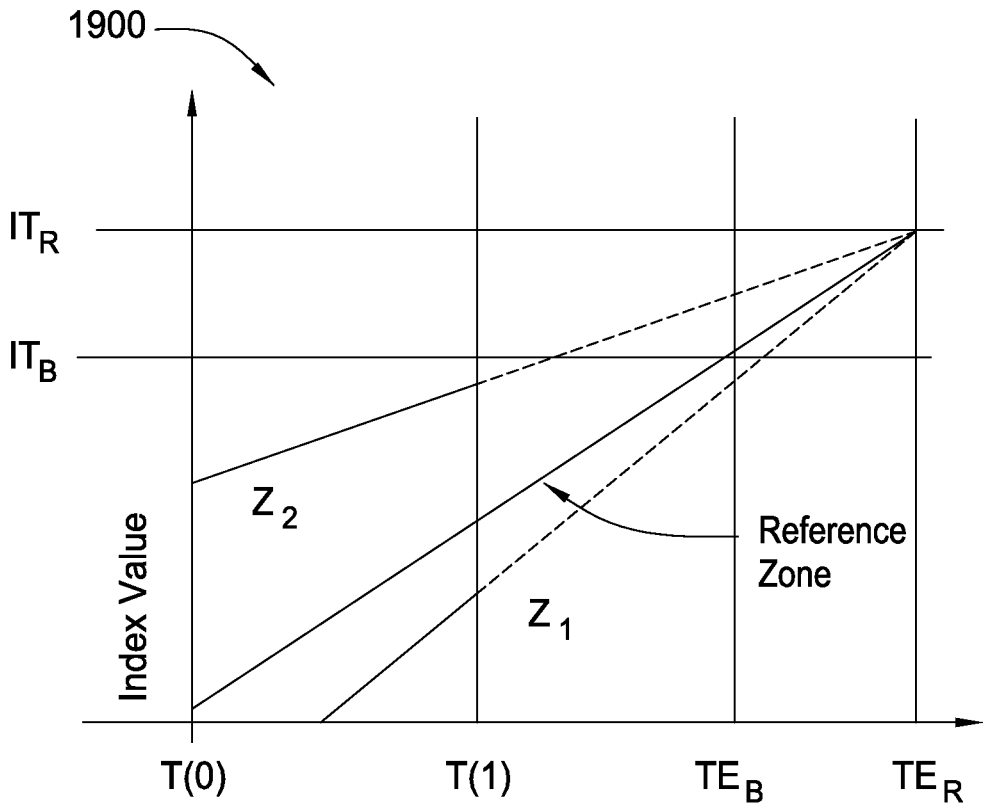
FIG. 19 is a plot depicting another method of polishing a substrate according to implementations described herein.

FIG. 19 is a plot 1900 depicting another method of polishing a substrate according to implementations described herein. Rather than targeting a flat post profile before entering the residual clearing process (e.g., at the intersection of $IT_B$ and $TE_R$) as previously discussed, the method depicted in flow diagram 1600 uses dynamic ISPC to target a flat post profile at the end of the residual clearing process (e.g., at the intersection of $IT_R$ and $IE_R$). The estimated endpoint target level for the ISPC may be determined from a dynamic ISPC library created from substrates polished using open-loop (fixed pressure) control processes using motor torque endpoint techniques or other endpoint control methods as previously described herein. The same polishing recipe may be used for both the bulk polishing process and the residual polishing process. For subsequent wafers, the ISPC can be used to control polishing pressures and endpoint. Feedback may be generated to automatically update the ISPC algorithm. Feedback may be calculated based on the index at the end of the residual polishing process or at the end of overpolishing. The method depicted in plot 1900 may be extended to any CMP residue clearing process. The polishing profile may be controlled with or without overpolishing. The polishing time may be controlled using other methods including advanced process control (APC), optical or other friction measurements.

As depicted in plot 1900, ISPC methods are used to adjust the polishing pressure at T(1) within the same substrate based on polishing information obtained prior to T(1) such that the plurality of zones ($Z_1$ and $Z_2$) have approximately the same index value at the expected endpoint time ($E_R$). The polishing information may be used in a feedback loop to improve polishing of the next wafer.

In certain implementations where the total polishing time is short it may be desirable to begin adjusting polishing pressure at T(0) based on the adjusted polishing pressures from previously polished substrates.

The techniques described above can also be applicable for monitoring of metal layers using an eddy current system. In this case, rather than performing matching of spectra, the layer thickness (or a value representative thereof) is measured directly by the eddy current monitoring system, and the layer thickness is used in place of the index value for the calculations.

The method used to adjust endpoints can be different based upon the type of polishing performed. For copper bulk polishing, a single eddy current monitoring system can be used. For copper-clearing CMP with multiple wafers on a single platen, a single eddy current monitoring system can first be used so that all of the substrates reach a first breakthrough at the same time. The eddy current monitoring system can then be switched to a laser monitoring system to clear and over-polish the wafers. For barrier and dielectric CMP with multiple wafers on a single platen, an optical monitoring system can be used.

Implementations of the invention and all of the functional operations described in this specification can be implemented in digital electronic circuitry, or in computer software, firmware, or hardware, including the structural means disclosed in this specification and structural equivalents thereof, or in combinations of them. Implementations of the invention can be implemented as one or more computer program products, i.e., one or more computer programs tangibly embodied in a machine-readable storage media, for execution by, or to control the operation of, data processing apparatus, e.g., a programmable processor, a computer, or multiple processors or computers. A computer program (also known as a program, software, software application, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file. A program can be stored in a portion of a file that holds other programs or data, in a single file dedicated to the program in question, or in multiple coordinated files (e.g., files that store one or more modules, sub-programs, or portions of code). A computer program can be deployed to be executed on one computer or on multiple computers at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application-specific integrated circuit).

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a circular (or some other shape) pad secured to the platen. Some aspects of the endpoint detection system may be applicable to linear polishing systems, e.g., where the polishing pad is a continuous or a reel-to-reel belt that moves linearly. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

While the foregoing is directed to implementations of the present invention, other and further implementations of the invention may be devised without departing from the basic scope thereof, and the scope thereof is determined by the claims that follow.

The invention claimed is:

1. A method for polishing a substrate, comprising:

polishing a substrate having a plurality of zones to remove a bulk material layer in a polishing apparatus having a rotatable platen, wherein a polishing rate of each zone of the plurality of zones is independently controllable by an independently variable polishing parameter;

storing a bulk target index value;

measuring a first sequence of values from each zone of the plurality of zones during polishing with an in-situ monitoring system;

for each zone of the plurality of zones, fitting a first linear function to the first sequence of values;

for a reference zone of the plurality of zones, determining an expected bulk endpoint time at which the reference zone will reach the bulk target index value based on the first linear function of the reference zone;

for at least one adjustable zone of the plurality of zones, calculating a first adjustment for the polishing parameter for the adjustable zone to adjust the polishing rate of the adjustable zone such that the adjustable zone is closer to the bulk target index value at the expected bulk endpoint time than without such adjustment, the calculation including calculating the first adjustment based on an error value calculated for a previous substrate;

after adjustment of the polishing parameter, for each zone, during polishing measuring a second sequence of values obtained after the first adjustment of the polishing parameter;

for the at least one adjustable zone of each substrate, fitting a second linear function to the second sequence of values;

calculating error values for a subsequent substrate for the at least one adjustable zone based on the second linear function and a desired slope;

determining an expected clearing endpoint time for removal of a residual material that either the first or second linear function of the reference zone will reach a clearing target index value;

for at least one adjustable zone, calculating a second adjustment for the polishing parameter for the adjustable zone to adjust the polishing rate of the adjustable zone such that the adjustable zone is closer to the clearing target index value at the expected clearing endpoint time than without such adjustment, the calculation including calculating the adjustment based on an error value calculated for a previous substrate;

continue polishing the plurality of zones to remove the bulk material layer until the expected bulk endpoint time passes; and polishing the plurality of zones to remove the residual material layer using the second adjusted polishing parameter such that the adjustable zone is closer to the clearing target index value at the expected clearing endpoint time.

2. The method of claim 1, wherein the substrate is polished for a predetermined time, and the bulk target index value is the number of platen rotations at the predetermined time.

3. The method of claim 1, wherein the independently variable polishing parameter is the pressure applied by a carrier head of the polishing apparatus to the substrate above a particular zone of the plurality of zones.

4. The method of claim 1, wherein the error value calculated for a previous substrate is based on the variation of the actual polishing rate of the zone of one or more previous substrates from the desired polishing rate for the zone of those previous substrates.

5. The method of claim 4, wherein the error value calculated for a previous substrate is used as a scaling factor to adjust the modification to the pressure on the adjustable zone.

6. The method of claim 1, wherein the first in-situ monitoring system is a spectrographic monitoring system.

7. The method of claim 1, wherein the expected bulk endpoint time is detected using at least one of a motor torque monitoring system, an eddy current monitoring system, a friction monitoring system, or a monochromatic optical system.

8. The method of claim 1, wherein the expected bulk endpoint time is predetermined or calculated as a combination of expected endpoint times of multiple zones.

9. The method of claim 1, wherein the expected bulk endpoint time is determined based on the bulk endpoint time of previously polished substrates.

10. The method of claim 9, wherein the error value calculated for a previous substrate is based on the variation of the actual polishing rate of the zone of one or more previous substrates from the desired polishing rate for the zone of those previous substrates.

11. The method of claim 10, wherein the error value calculated for a previous substrate is used as a scaling factor to adjust the modification to the pressure on the adjustable zone.

12. A method for polishing a substrate, comprising:

polishing a substrate having a plurality of zones to remove a bulk material layer in a polishing apparatus having a rotatable platen, wherein a polishing rate of each zone of the plurality of zones is independently controllable by an independently variable polishing parameter;

obtaining measured spectrum for current platen revolution for each zone of the plurality of zones;

determining a reference spectrum that is a best match to the measured spectrum for each zone of the plurality of zones;

generating a sequence of index values by determining an index value for each reference spectrum that is best fit;

fitting a first linear function to the sequence of index values for each zone of the plurality of zones;

determining an expected bulk endpoint time that the first linear function for a reference zone of the plurality of zones will reach a bulk target index value;

adjusting polishing parameters for each zone of the plurality of zones including using error values from any prior substrate such that the plurality of zones have approximately the same index value at the expected bulk endpoint time;

continue polishing, measuring spectra, determining error values and a second sequence of index values, and fitting a second linear function to the second sequence of index values;

determining an expected clearing endpoint time that either the first or second linear function for the reference zone will reach a clearing target index value;

continue polishing the plurality of zones to remove the bulk material layer until the expected bulk endpoint time passes; and adjusting polishing parameters to polish the plurality of zones including using error values from any prior substrate to remove a residual material layer after the expected bulk endpoint time passes.

13. The method of claim 12, wherein removing a residual material layer after the expected bulk endpoint time passes further comprises:

determining a reference spectrum that is a best match to the measured spectrum for each zone of the plurality of zones;

generating a sequence of index values by determining an index value for each reference spectrum that is best fit;

fitting a first linear function to the sequence of index values for each zone of the plurality of zones;

adjusting the expected residual clearing endpoint time that the first linear function for the reference zone will reach a clearing target index value; and polishing until the reference zone reaches the adjusted expected clearing endpoint time.

14. The method of claim 13, wherein removing a residual material layer after the expected bulk endpoint time passes further comprises:

determining a new sequence of index values and fitting a second linear function to the new sequence of index values; and determining error values for feedback to polishing of subsequent substrates.

15. The method of claim 14, further comprising:

loading one or more new substrates onto the polishing pad; and polishing the one or more substrates based on the adjusted polishing parameters.

16. The method of claim 15, further comprising:

obtaining measured spectrum for current platen revolution for each zone of the plurality of zones of the one or more new substrates;

determining a reference spectrum that is a best match to the measured spectrum for each zone of the plurality of zones of the one or more new substrates; and generating a sequence of index values by determining an index value for each reference spectrum that is best fit for the one or more new substrates.

17. The method of claim 12, wherein the independently variable polishing parameter is a pressure in a carrier head of the polishing apparatus.

18. The method of claim 12, wherein the substrate is polished for a predetermined time, and the bulk target index value is the number of platen rotations at the predetermined time.

19. The method of claim 12, wherein the measured spectrum are obtained using an in-situ spectrographic monitoring system.

20. The method of claim 12, wherein the expected bulk endpoint time is detected using at least one of a motor torque monitoring system, an eddy current monitoring system, a friction monitoring system, or a monochromatic optical system.

* * * * *

UNITED STATES PATENT AND TRADEMARK OFFICE

CERTIFICATE OF CORRECTION

PATENT NO. : 9,242,337 B2
APPLICATION NO. : 14/185185
DATED : January 26, 2016
INVENTOR(S) : Qian et al.

It is certified that error appears in the above-identified patent and that said Letters Patent is hereby corrected as shown below:

Specification

Column 9, Line 43, please delete "(Ts=T2-T1" (D1-D)/(D1-D2))" and insert
-- (Ts=T2-T1*(D1-D)/(D1-D2)) -- therefor;

Column 14, Line 17, please delete "E12, E13, and E14" and insert -- EI2, EI3, and EI4 -- therefor;

Column 14, Line 20, please delete "E12" and insert -- EI2 -- therefor;

Column 14, Line 23, please delete "E13" and insert -- EI3 -- therefor;

Column 14, Line 25, please delete "E14" and insert -- EI4 -- therefor;

Column 14, Line 35, please delete "E12" and insert -- EI2 -- therefor;

Column 14, Line 38, please delete "E13" and insert -- EI3 -- therefor;

Column 15, Line 32, please delete "I(IT-I)=SD*(TE-T0)" and insert
-- (IT-I)=SD*(TE-T0) -- therefor;

Column 15, Line 55, please delete "(TE-T0)" and insert -- (TE'-T0) -- therefor;

Column 16, Line 26, please delete "Fold" and insert -- Pold -- therefor;

Column 18, Line 10, please delete "Fold" and insert -- Pold -- therefor.

Signed and Sealed this
Twenty-sixth Day of April, 2016

Michelle K. Lee

Michelle K. Lee
*Director of the United States Patent and Trademark Office*